US007215229B2

(12) United States Patent
Shen et al.

(10) Patent No.: US 7,215,229 B2
(45) Date of Patent: May 8, 2007

(54) LAMINATED RELAYS WITH MULTIPLE FLEXIBLE CONTACTS

(75) Inventors: Jun Shen, Phoenix, AZ (US); Cheng Ping Wei, Gilbert, AZ (US)

(73) Assignee: Schneider Electric Industries SAS (FR)

( * ) Notice: Subject to any disclaimer, the term of this patent is extended or adjusted under 35 U.S.C. 154(b) by 80 days.

(21) Appl. No.: 10/740,837

(22) Filed: Dec. 22, 2003

(65) Prior Publication Data

US 2005/0057329 A1 Mar. 17, 2005

Related U.S. Application Data

(63) Continuation-in-part of application No. 10/664,404, filed on Sep. 17, 2003.

(51) Int. Cl.
*H01H 51/22* (2006.01)

(52) U.S. Cl. ..... 335/78; 200/181

(58) Field of Classification Search ..... 335/78, 335/151–153; 200/181
See application file for complete search history.

(56) References Cited

U.S. PATENT DOCUMENTS 4,065,677 A 12/1977 Micheron et al.
4,461,968 A 7/1984 Kolm et al.
4,496,211 A 1/1985 Daniel
4,570,139 A 2/1986 Kroll
4,755,706 A 7/1988 Harnden, Jr. et al.
4,979,149 A * 12/1990 Popovic et al. ..... 365/244
5,016,978 A 5/1991 Fargette et al.
5,048,912 A 9/1991 Kunikane et al.
5,072,228 A * 12/1991 Kuwahara ..... 342/360
5,398,011 A 3/1995 Kimura et al.

(Continued)

FOREIGN PATENT DOCUMENTS

DE 198 20 821 C1 12/1999

(Continued)

OTHER PUBLICATIONS

International Search Report for International Application No. PCT/US03/29254 mailed on Mar. 5, 2004.

(Continued)

*Primary Examiner*—Elvin Enad
*Assistant Examiner*—Bernard Rojas
(74) *Attorney, Agent, or Firm*—Sterne, Kessler, Goldstein & Fox

(57) ABSTRACT

Methods and systems of assembling and making laminated electro-mechanical system (LEMS) switches are described. A plurality of structural layers are formed that include at least two structural layers that each include a flexible member. The plurality of structural layers are stacked and aligned into a stack, to form at least one switch. Each structural layer in the stack is attached to an adjacent structural layer of the stack. When the formed switch is in an "on" state, the first flexible member is in contact with the second flexible member. When making contact with the second flexible member, the second flexible member flexes in response. In a further aspect, three flexible members may be present. When the switch is in an "on" state, the first flexible member is in contact with the second and third flexible members. When making contact with the second and third flexible members, the second and third flexible members flex in response.

37 Claims, 21 Drawing Sheets

U.S. PATENT DOCUMENTS

| | | | | |
|---|---|---|---|---|
| 5,430,421 | A * | 7/1995 | Bornand et al. | 335/154 |
| 5,454,904 | A | 10/1995 | Ghezzo et al. | |
| 5,472,539 | A | 12/1995 | Saia et al. | |
| 5,475,353 | A | 12/1995 | Roshen et al. | |
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillan et al. | |
| 6,191,671 | B1 * | 2/2001 | Schlaak et al. | 335/78 |
| 6,297,072 | B1 | 10/2001 | Tilmans et al. | |
| 6,410,360 | B1 * | 6/2002 | Steenberge | 438/52 |
| 6,511,894 | B2 | 1/2003 | Song | |
| 6,621,390 | B2 * | 9/2003 | Song et al. | 335/78 |

FOREIGN PATENT DOCUMENTS

| | | | |
|---|---|---|---|
| DE | 100 31 569 | A1 | 2/2001 |
| EP | 0 452 012 | A2 | 10/1991 |
| EP | 0 452 012 | A3 | 10/1991 |
| EP | 0 685 864 | A1 | 12/1995 |
| EP | 0 709 911 | A2 | 5/1996 |
| EP | 0 780 858 | A1 | 6/1997 |
| EP | 0 869 518 | A1 | 10/1998 |
| EP | 0 887 879 | A1 | 12/1998 |
| FR | 2 572 546 | | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 99/27548 | | 6/1999 |

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, 1998, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 54161952, published Dec. 22, 1979, 1 page.

English-Language Abstract of WO 9927548, published Jun. 3, 1999, 1 page.

* cited by examiner

FIG. 1B
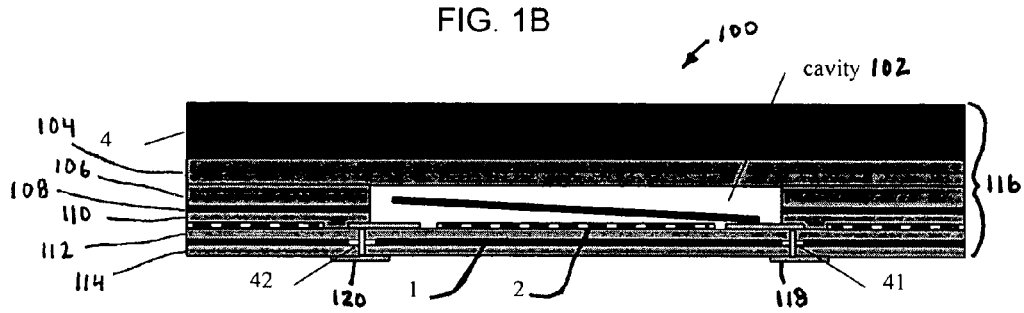
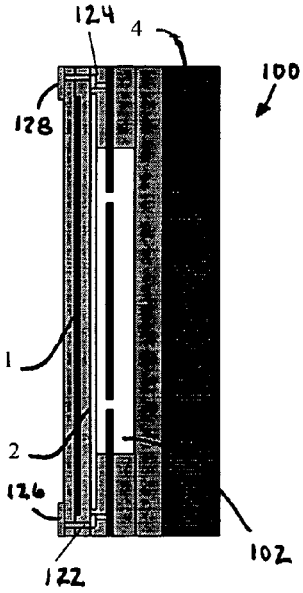
FIG. 1C
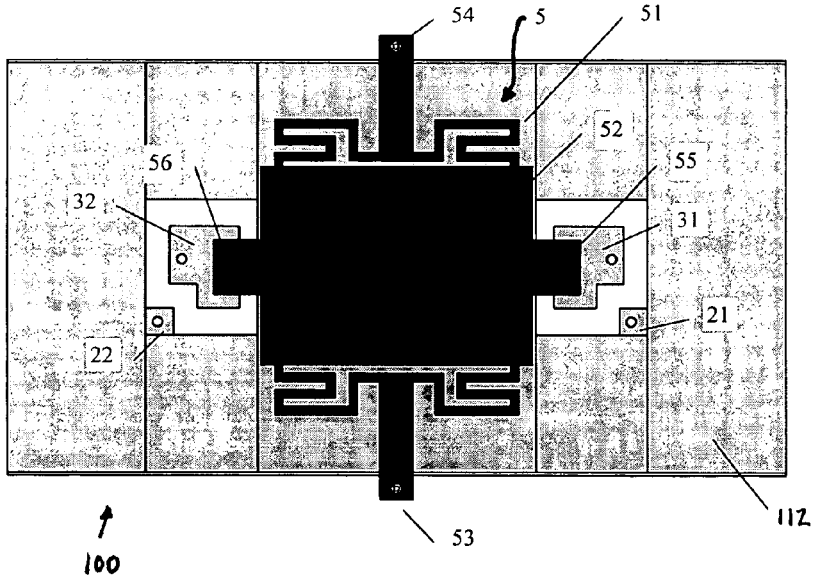
FIG. 1A

LAMINATED RELAYS WITH MULTIPLE FLEXIBLE CONTACTS

This is a continuation-in-part application of pending U.S. application Ser. No. 10/664,404, filed Sep. 17, 2003, which is herein incorporated by reference in its entirety.

BACKGROUND OF THE INVENTION

1. Field of the Invention

The present invention relates to electro-mechanical systems. More specifically, the present invention relates to the assembly of electro-mechanical systems by lamination of layers to form magnetic latching switches, and the like.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

The basic elements of a latching micro-magnetic switch include a permanent magnet, a substrate, a coil, and a cantilever at least partially made of soft magnetic materials. In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states, or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

What is desired are electro-mechanical devices, including latching micro-magnetic switches, that are reliable, simple in design, low-cost and easy to manufacture. Hence, what is further desired is improved methods and systems for manufacturing electro-mechanical devices.

BRIEF SUMMARY OF THE INVENTION

Methods and systems for assembling and making laminated electro-mechanical systems (LEMS), structures, and devices are described herein. In a first aspect, a system and method of assembling an electro-mechanical structure is provided. A stack of structural layers is aligned. The stack includes at least one structural layer having a movable element formed therein. Each structural layer of the stack is attached to an adjacent structural layer of the stack.

Numerous types of structural layers may be positioned in the stack. In an aspect, a structural layer that includes a permanent magnet is positioned in the stack. In another aspect, a structural layer that includes a high permeability magnetic material is positioned in the stack. In another aspect, a structural layer that includes at least a portion of an electromagnet is positioned in the stack. In another aspect, a structural layer that includes at least one electrical contact area formed thereon is positioned in the stack. Further structural layer types may be positioned in the stack.

The movable element can be a micro-machined movable element. In a further aspect, a first structural layer that includes the micro-machined movable element is positioned in the stack.

In a further aspect, a cavity may be formed in the stack by positioning the structural layer having the movable element between a second structural layer having an opening therethrough and a third structural layer having an opening therethrough. The cavity may be formed such that the movable element is capable of moving in the cavity during operation of the movable element.

In a still further aspect, the plurality of structural layers are formed.

In another aspect, one or more laminated electro-mechanical structures are assembled or made according to the methods and systems described herein. These structures form devices that can be vertically stacked upon one another and/or laterally spaced apart. In either case, the devices can be electrically and/or optically coupled to form a circuit. Alternatively, they can be coupled (electrically and/or optically) to other discrete or integrated circuits.

In another aspect of the present invention, a latching switch having two or more flexible contact members is assembled using LEMS techniques. A plurality of layers are attached together in a stack. A layer having a first flexible member is positioned/inserted into the stack. A layer having a second flexible member is positioned/inserted into the stack. During operation of the switch, the first flexible member can contact the second flexible member. For example, during contact, an electrical connection can be made between the first and second flexible members.

Furthermore, when the first flexible member moves into contact with the second flexible member, the second flexible member flexes in response. The flex response of the second flexible member provides many benefits for the switch, including reduced contact bounce, reduced settling time, increased lifetime and reliability, among other benefits.

In a further aspect, the layer having the second flexible member includes a third flexible member. During operation of the switch, the first flexible member can contact both the second and third flexible members simultaneously. For example, an electrical connection can be made between the second and third flexible members through the first flexible member. When the first flexible member moves into contact with them, the second and third flexible members both flex in response.

The switch may be actuated in various ways. In an example magnetic actuation aspect of the present invention, the first flexible member has a magnetic material and a longitudinal axis. A permanent magnet layer that produces a first magnetic field is positioned/inserted into the stack. The first magnetic field induces a magnetization in the magnetic material. The magnetization is characterized by a magnetization vector pointing in a direction along the longitudinal axis of the first flexible member. The first magnetic field is approximately perpendicular to the longitudinal axis. A layer that includes a coil is inserted into the stack. The coil is capable of producing a second magnetic field. The second magnetic field causes the first flexible member to switch between a first stable state and a second stable state. In first stable state, the first flexible member is in contact with the second flexible member, which flexes in response. In the second stable state, the first flexible member is not in contact with the second flexible member.

These and other objects, advantages and features will become readily apparent in view of the following detailed description of the invention.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

FIGS. 1A–1C show views of a laminated electro-mechanical system, according to an embodiment of the present invention.

Figure 22:
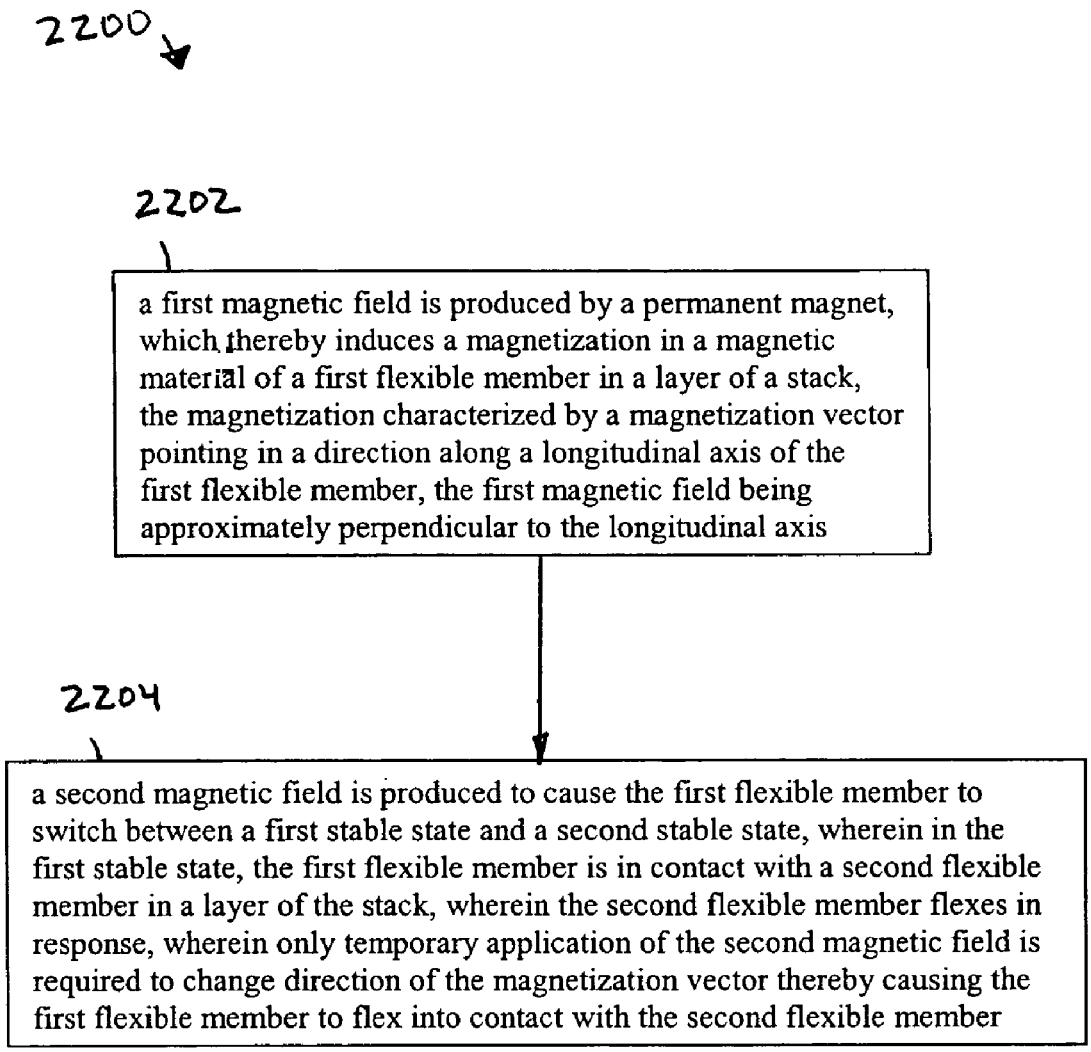

FIG. 22 shows a flowchart providing example steps for operating a magnetically actuated latching switch with multiple flexible members, according to an example embodiment of the present invention The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

It should be appreciated that the particular implementations shown and described herein are examples of the invention and are not intended to otherwise limit the scope of the present invention in any way. Indeed, for the sake of brevity, conventional electronics, manufacturing, laminated electro-mechanical and MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that the manufacturing techniques described herein could be used to create mechanical relays, optical relays, any other switching device, and other component types. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal suicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in international patent publications WO0157899 (titled Electronically Switching Latching Micro-magnetic Relay And Method of Operating Same), and WO0184211 (titled Electronically Micro-magnetic latching switches and Method of Operating Same), to Shen et al. These patent publications provide a thorough background on micro-magnetic latching switches and are incorporated herein by reference in their entirety. Moreover, the details of the switches disclosed in WO0157899 and WO0184211 are applicable to implement the switch embodiments of the present invention as described below.

Laminated Electro-Mechanical Systems

The present invention relates to laminated electro-mechanical systems (LEMS) and structures. In the laminated electro-mechanical systems and structures of the present invention, various layers of materials with predefined patterns are formed. The layers are aligned relative to each other, and laminated together or built-up, to form a multi-layer structure or stack. Movable mechanical elements can be created in one or more layers of the stack. A movable element is provided with space to move in the stack by creating a cavity in the stack. To create a cavity, layers with openings are aligned on one or both sides of the layer having the movable element. The movable elements are allowed to move freely in the formed cavity after lamination together of the various layers.

Typically, the layers are substantially planar in shape. However, in some embodiments, various layers may have features that do extend out of the plane of the layer.

The present invention may include any type of actuation mechanism to control movement of the movable mechanical elements. Example applicable actuation mechanisms include electrical, electrostatic, magnetic, thermal, and piezoelectric actuation mechanisms. Note that for illustrative purposes, a micro-mechanical latching switch having a magnetic actuation mechanism is described herein as being made as a laminated electro-mechanical system or structure. It is to be understood from the teachings herein that switches having other actuation mechanisms can also be made as a laminated electro-mechanical system or structure.

The laminated electro-mechanical systems and structures of the present invention provide numerous advantages. An advantage of the present invention includes low cost. The material(s) used for the layers of the present invention are conventional materials that are relatively inexpensive. Conventional techniques may be used to form patterns in the layers, including screen-printing, etching (e.g., photolithography or chemical), ink jet printing, and other techniques. Furthermore, conventional lamination techniques can be used to attach the layers together.

Another advantage of the present invention is that it is relatively easy to produce. The layers of the present invention are formed. The layers are then merely aligned and attached to each other. Complicated attachment mechanisms are not required. As described above, conventional techniques may be used to attach the layers. Furthermore, laminated electro-mechanical systems and structures may be made in large sheets that include large numbers of the devices to provide economies of scale.

Another advantage of the present invention is an ease in integration of laminated electro-mechanical systems and structures with other electronic components (e.g., inductors, capacitors, resistors, antenna patterns, filters). The other electronic components may be formed on one or more of the layers when they are preformed, prior to placement in the stack, for example.

Still another advantage of the present invention is an ease in scaling up or down the dimensions of the laminated electro-mechanical systems and structures to better handle different levels of power. The laminated electro-mechanical systems and structures may be scaled down to the level of micro-machined structures and devices, for example. Such micro-machined structures and devices require small amounts of power. The laminated electro-mechanical systems and structures may also be scaled up to larger sized structures and devices.

Assembling Laminated Electro-Mechanical Structures According to the Present Invention Embodiments for making and assembling laminated electro-mechanical systems and structures according to the present invention are described in detail as follows. These implementations are described herein for illustrative purposes, and are not limiting. The laminated electro-mechanical systems and structures of the present invention, as described in this section, can be assembled in alternative ways, as would be apparent to persons skilled in the relevant art(s) from the teachings herein.

FIGS. 1A–1C show views of a laminated electro-mechanical system 100, according to an embodiment of the present invention. FIG. 1A shows a plan view of laminated electro-mechanical system 100. FIGS. 1B and 1C show cross-sectional views of laminated electro-mechanical system 100. For illustrative purposes, laminated electro-mechanical system 100 is shown as including a micro-magnetic latching switch. However, it is noted that the present invention as described herein is also applicable fabrication of latching switches with other actuation mechanisms, and to fabrication of other larger scale and micro-machined device types.

As shown in FIGS. 1A–1C, laminated electro-mechanical system 100 includes a high-permeability (e.g., permalloy) layer 1, an electromagnet or coil 2 having contacts 21 and 22, bottom contacts 31 and 32, a permanent magnet 4, a cantilever assembly 5, and further lamination layers. Cantilever assembly includes contacts 53 and 54, a cantilever body 52 (e.g., made of a soft magnetic material such as a permalloy), and contact tips 55 and 56, and is supported by torsion flexures 51. Cantilever body 52 is a movable element that is positioned inside a cavity 102 so that it can toggle freely between contacts 31 and 32 during operation of the latching switch. Example operation of the latching switch is further described above.

Figure 2A:
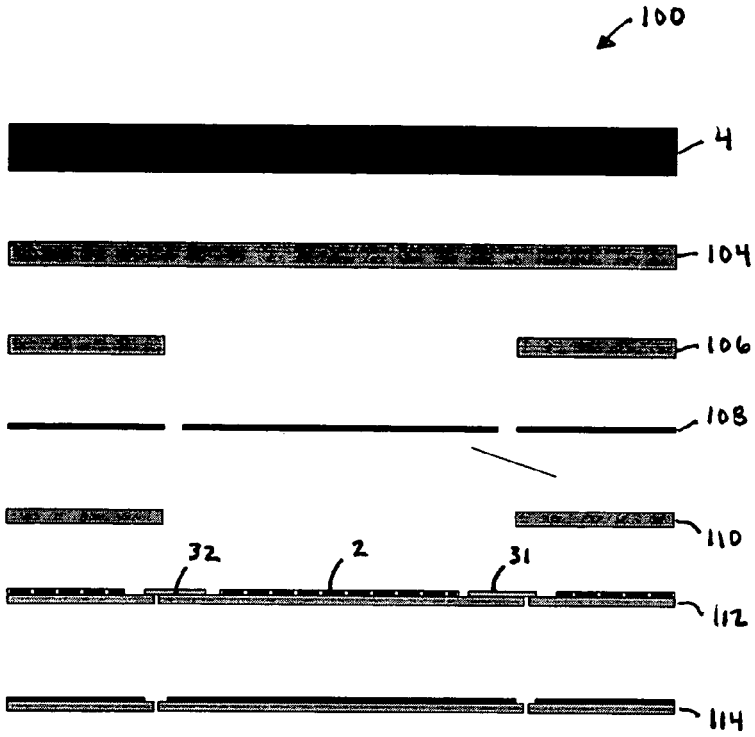
FIG. 2A shows side views of separated layers of the laminated electro-mechanical system shown in FIGS. 1A–1C.
Figure 2B:
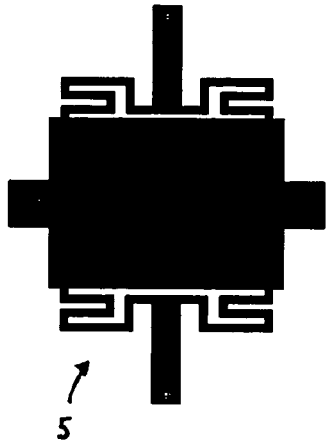
FIG. 2B shows a top view of the cantilever assembly of the laminated electro-mechanical system shown in FIGS. 1A–1C.

To fabricate the latching switch shown in FIGS. 1A–1C, various patterns and openings are first defined and formed on the structural lamination layers or built up with other materials. These structural layers are shown in FIGS. 1A–1C, and are also shown in FIG. 2A, where laminated electro-mechanical system 100 is shown in exploded form. As shown in FIGS. 1B and 2A, laminated electro-mechanical system 100 includes a structural layer formed substantially by permanent magnet 4, a first substrate layer 104, a first spacer layer 106, a movable element layer 108, a second spacer layer 110, a coil layer 112, and a second substrate layer 114. FIG. 2B shows a plan view of cantilever assembly 5.

The structural layers can be formed from a variety of materials. For example, in an embodiment, the structural layers can be formed from thin films that are capable of at least some flexing, and have large surface areas. Alternatively, structural layers can be formed from other materials. The structural layers can be electrically conductive or non-conductive. For example, the structural layers can be formed from inorganic or organic substrate materials, including plastics, glass, polymers, dielectric materials, etc. Example organic substrate materials include "BT," which includes a resin called bis-maleimide triazine, "FR-4," which is a fire-retardant epoxy resin-glass cloth laminate material, and/or other materials. In electrically conductive structural layer embodiments, structural layers can be formed from a metal or combination of metals/alloy, or from other electrically conductive materials.

As shown in FIG. 1B, the structural layers are aligned and stacked together to form a stack 116. The structural layers are attached to each other in the stack with an adhesive material (not shown). The adhesive material may be an adhesive tape, or an interfacial glue layer, such as an epoxy (e.g. a B-stage epoxy) applied/located between the structural layers. If the adhesive material requires curing, such as thermal curing, stack 116 can be heated to a suitable temperature to cure the adhesive material, and attach the structural layers together.

As shown in FIGS. 1B and 1C, a cavity 102 is formed aligning the openings through first and second spacer layers 106 and 110 on either side of movable element layer 108. Cavity 102 allows the movable element of movable element layer 108 (e.g., cantilever body 52) to move freely to contact one or more electrical contacts, such as contacts 31 and 32 shown in FIG. 1A. Contacts 31 and 32 are formed on coil layer 112 in the example of FIGS. 1A–1C.

One or more vias may be formed in structural layers to allow electrical contact between elements in system 100 and elements exterior to system 100. As shown in FIG. 1B, for example, vias 41 and 42 electrically couple contact areas 31 and 32, respectively, to contact pads 118 and 120 formed on a surface of second substrate layer 114. Furthermore, as shown in FIG. 1C, vias 122 and 124 electrically couple contacts 53 and 54 to contact pads 126 and 128 formed on a surface of second substrate layer 114. Vias may be formed in any number of one or more structural layers. Vias through multiple layers can be aligned to allow electrical connections between any structural layers.

Note that although a single latching switch is shown in the embodiment of FIGS. 1A–1C, it should be understood that multiple micro-mechanical devices can be patterned on the lamination layers and batch fabricated. The multiple micro-mechanical devices can be left together, or can be separated by cutting.

Figure 3A:
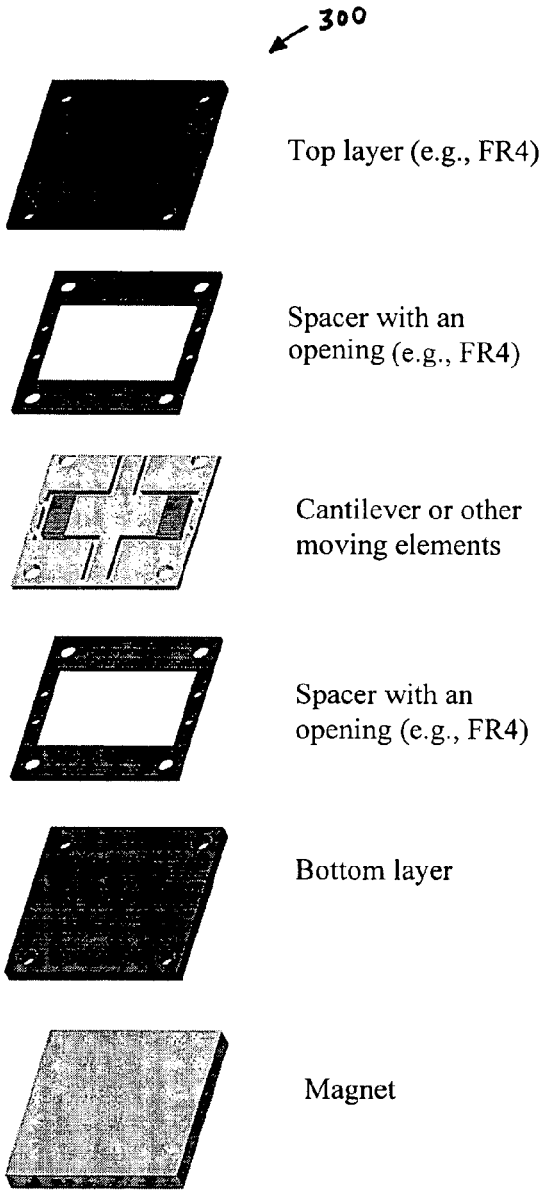
FIG. 3A illustrates separated layers of a laminated electro-mechanical system that may be assembled to form a cavity for a movable element, according to an embodiment of the present invention.
Figure 3B:
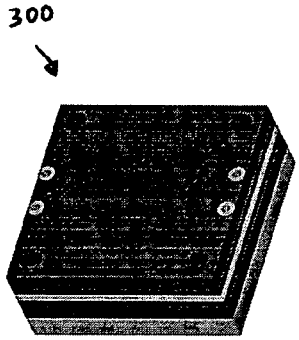
FIG. 3B illustrates the attachment together of the separated layers shown in FIG. 3A, according to an example embodiment of the present invention.

FIG. 3A illustrates separated layers of a laminated electro-mechanical system 300 that may be assembled to form a cavity for a movable element, according to a further example embodiment of the present invention. FIG. 3B illustrates the attachment together of the separated layers shown in FIG. 3A to form laminated electro-mechanical system 300, according to an example embodiment of the present invention.

Figure 7A:
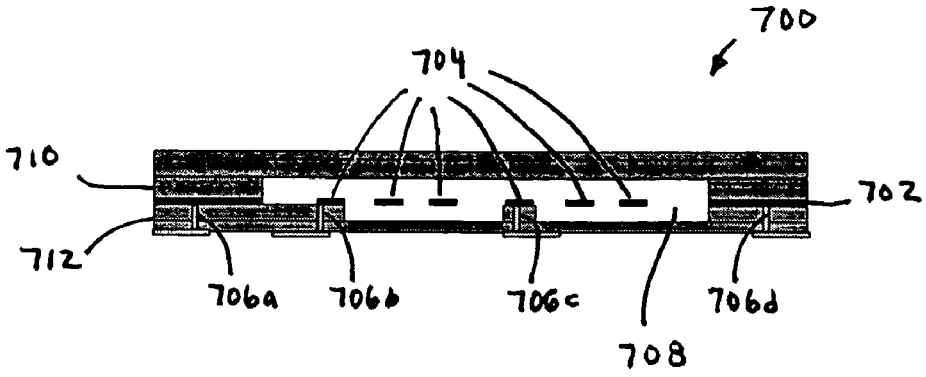
FIGS. 7A and 7B illustrate side and top views of an inductor layer that can be used in a laminated electro-mechanical system, according to an example embodiment of the present invention.
Figure 7B:
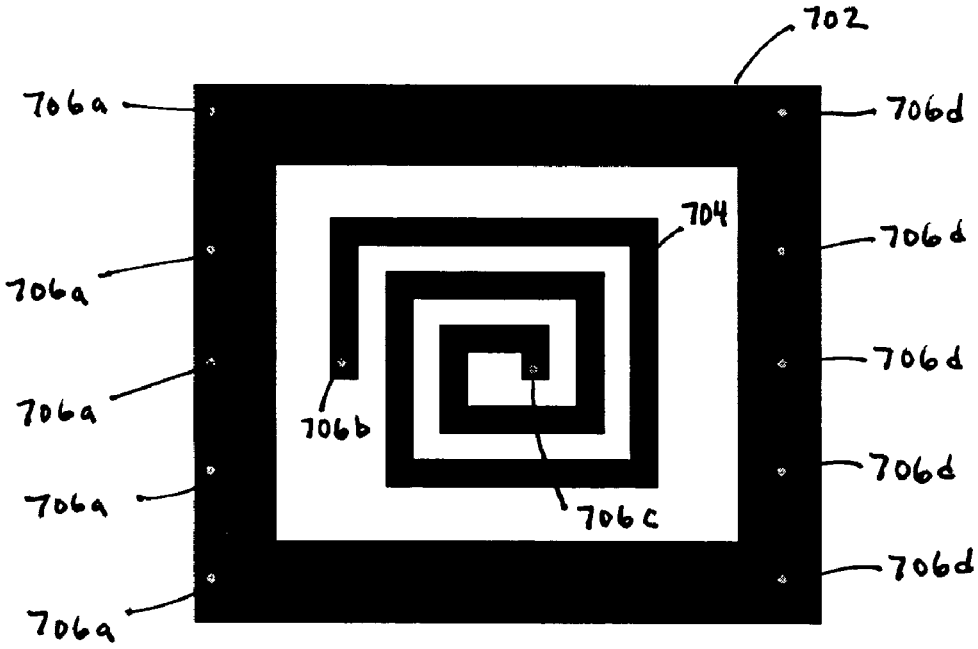

Note that various electronic devices or components, including switches, inductors, capacitors, resistors, antenna patterns, and others, can also be fabricated similarly to the processes described herein. For example, FIGS. 7A and 7B illustrate a laminated electro-mechanical system 700 that includes a structural layer having an inductor 704 and ground plane 702 present. As shown in FIG. 7A, inductor 704 is located in a cavity 708. The open portion of cavity 708 is formed by first and second spacer layers 710 and 712. As shown in FIG. 7B, inductor 704 is formed as a planar coil. Ground plane 702 is electrically isolated from, and surrounds inductor 704 in the plane of the structural layer in which they reside. A plurality of vias 706*a*–706*d* are used to electrically couple ends of inductor 704, and portions of ground plane 704, to externally available contact pads on one or more surfaces of laminated electro-mechanical system 700. As shown in FIG. 7A, portions of inductor 704 are suspended. In such a suspended configuration, inductor 704 has a high quality factor. Furthermore, the planar configuration for inductor 704 reduces the cost of inductor 704.

Figure 4:
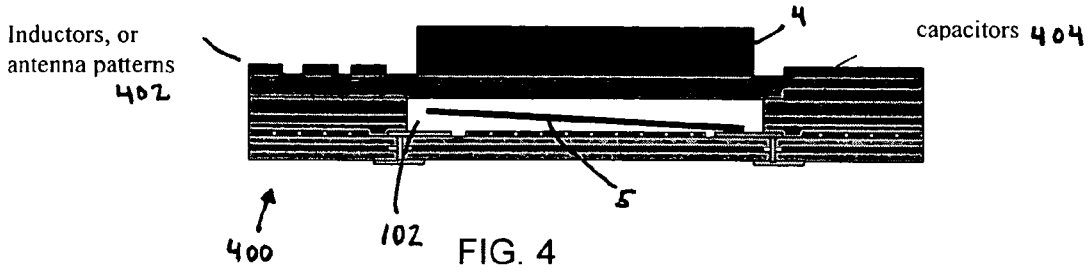
FIG. 4 illustrates a structure formed by the assembly process of the present invention that integrates switches with other components.

Furthermore, various electronic devices or components, including switches, inductors, capacitors, resistors, antenna patterns, and others may be integrated with embodiments of the present invention. For example, FIG. 4 illustrates a laminated electro-mechanical system 400 formed by the lamination assembly process of the present invention, that integrates an inductor or antenna pattern 402 and capacitors 404. The electrical contact areas of a latching switch of system 400 may be electrically coupled to the electrical components integrated therewith, by one or more vias, conductor lines, and/or other ways, to form a circuit on the same structure. For example, embodiments of the present invention may be combined with electrical components and/or devices to create reconfigurable filters, reconfigurable antennas, and other devices. Embodiments of the present invention may also be used with liquid crystal displays, and other display types. The laminated electro-mechanical systems and structures can be electrically and/or optically coupled with the electrical components and devices, for example.

Transmission lines, such as radio frequency transmission lines, can be accommodated in a laminated electro-mechanical system of the present invention. For example, in an embodiment, a radio frequency (RF) switch formed in a laminated electro-mechanical system of the present invention can be coupled to a radio frequency transmission line having a pair of conductive lines or traces. In one embodiment, the conductive lines or traces of the radio frequency transmission line can be formed in parallel on a single structural layer of a stack. In another embodiment, a first conductive line or trace of the radio frequency transmission line can be formed on a first structural layer of a stack, while a second conductive line or trace of the radio frequency transmission line can be formed on a second structural layer of the stack. An insulating or electrically non-conducting structural layer can be positioned in the stack between the first and second conductive lines or traces.

Figure 5:
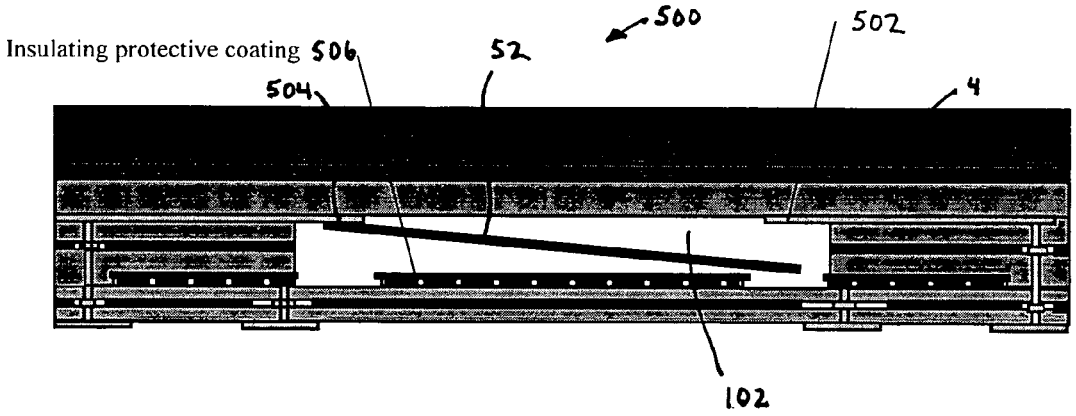
FIG. 5 illustrates a structure formed by the assembly process of the present invention that integrates switches with contacts on a top inner surface.

Note that contact areas for movable elements in laminated electro-mechanical systems 100, 300, and 400 may be positioned in various locations. For example FIG. 5 illustrates a structure or system 500 formed by the assembly process of the present invention that integrates a latching switch. Cantilever body 52 toggles to make contact with contact areas 502 and 504 on a top inner surface of cavity 102. Furthermore, contact area may be located on top and bottom surface in a single system.

Note that coil 2 can be formed on both the top and bottom sides of cantilever body 52. Furthermore, solenoid coils can be fabricated by connecting coil lines on two layers. As shown in FIG. 5, a coil 2 may be coated with an insulator 506 to protect the coil 2 from contact with cantilever body 52.

Furthermore, a movable element can be formed that is capable of movement in the plane of the structural layer in which it is formed. In other words, the movable element may be formed to have a degree of freedom that is coplanar with the plane of the structural layer in which it resides, as opposed to the movable element shown in FIG. 5, which has a degree of freedom that is not coplanar with the plane of the structural layer in which it resides.

Figure 12A:
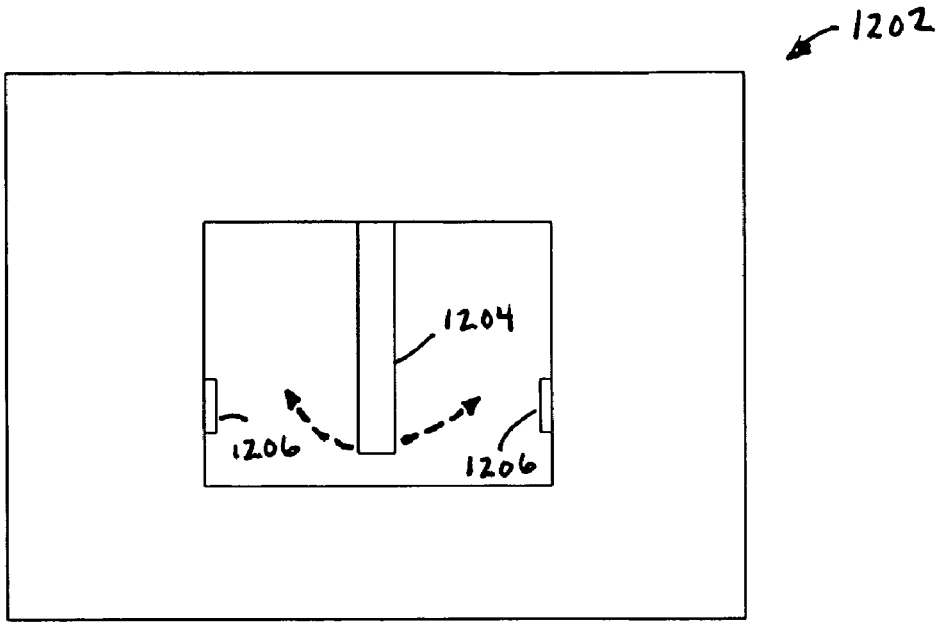
FIG. 12A shows an example movable element layer that includes a movable element capable of movement laterally in the movable element layer, according to an embodiment of the present invention.
Figure 12B:
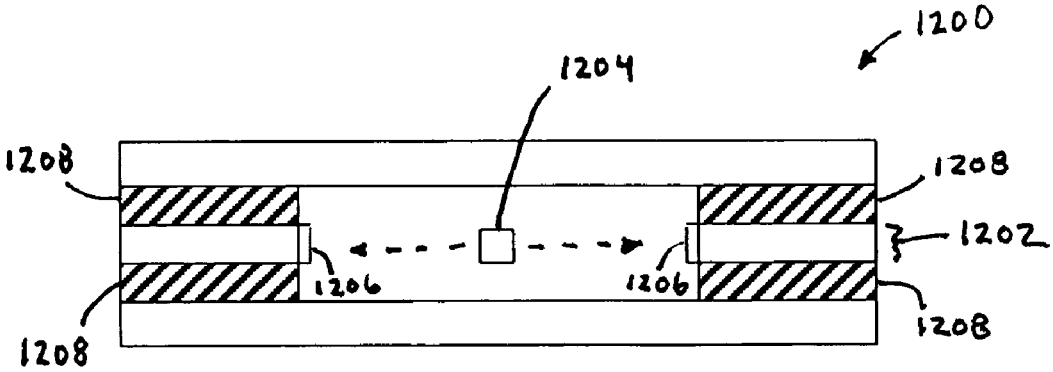
FIG. 12B shows a cross-sectional view of a laminated electro-mechanical system that includes the movable element layer shown in FIG. 12A, according to an embodiment of the present invention.

For example, FIG. 12A shows an example movable element layer 1202 that includes a movable element 1204 that is capable of movement laterally in movable element layer 1202. Movable element 1204 is capable of moving to make contact with one or more contact areas 1206. FIG. 12B shows a cross-sectional view of a laminated electro-mechanical system 1200 that includes movable element layer 1202. As shown in FIG. 12B, magnets and/or coils 1208 are used to actuate movement of movable element 1204 in the plane of movable element layer 1202. Embodiments such as that shown in FIGS. 12A and 12B may have reduced cavity size requirements than those in which the movable element is capable of movement outside of the plane of the structural layer in which the movable element resides.

In an embodiment, structural layers can be configured in a stack of a laminated electro-mechanical system to provide for hermetic sealing of elements of a portion or all of the stack. For example, in an embodiment, it may be desired to hermetically seal a moveable element and related contact(s) within a stack 116, such as those of cantilever assembly 5 shown in FIGS. 1A–1C, 2A, and 2B. In such an embodiment, one or more structural layers above and below cantilever assembly 5 can be formed from materials that are substantially impervious to moisture and/or other environmental hazards. For example, one or more of layers 104, 106, 110, 112, and 114 can be made from a glass material, or other suitable hermetic sealing material mentioned elsewhere herein, or otherwise known. In such a manner, for example, a hermetically sealed cavity 102 can be formed. Hermetically sealing structural layers can be formed around any elements in a stack 116 requiring to be hermetically sealed, including moveable elements, related contacts, coils, circuit elements (e.g., capacitors, resistors, inductors), magnets, and/or other elements. Note that any elements/layers of the laminated electro-mechanical system, including coils, permalloy layers, contacts, circuit elements, or other layers/elements of the device, can be formed on the hermetically sealing structural layers.

Figure 6:
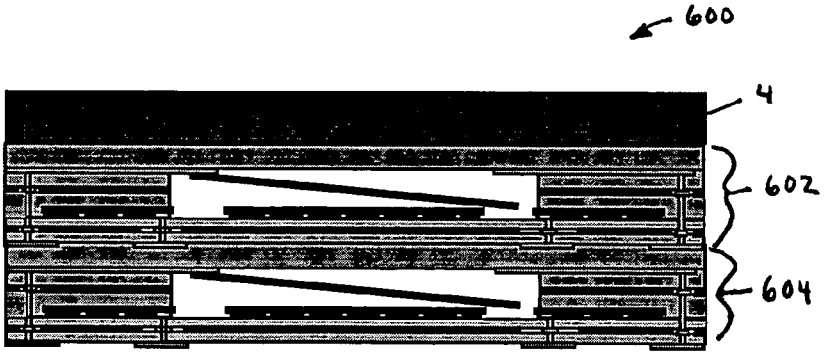
FIG. 6 illustrates a structure formed by the assembly process of the present invention that includes multiple switches and/or other elements integrated vertically, according to an embodiment of the present invention.

Note that multiple laminated electro-mechanical devices may be made or assembled according to the present invention in a vertically spaced or stacked configuration, or in a laterally spaced or co-planar configuration. For example, FIG. 6 illustrates a structure 600 formed by the assembly process of the present invention that includes multiple micro-mechanical systems 602 that are stacked or integrated vertically, according to an embodiment of the present invention. Multiple stacks of switches and other elements (inductors, capacitors, etc.) can be integrated vertically and laterally.

Figure 8:
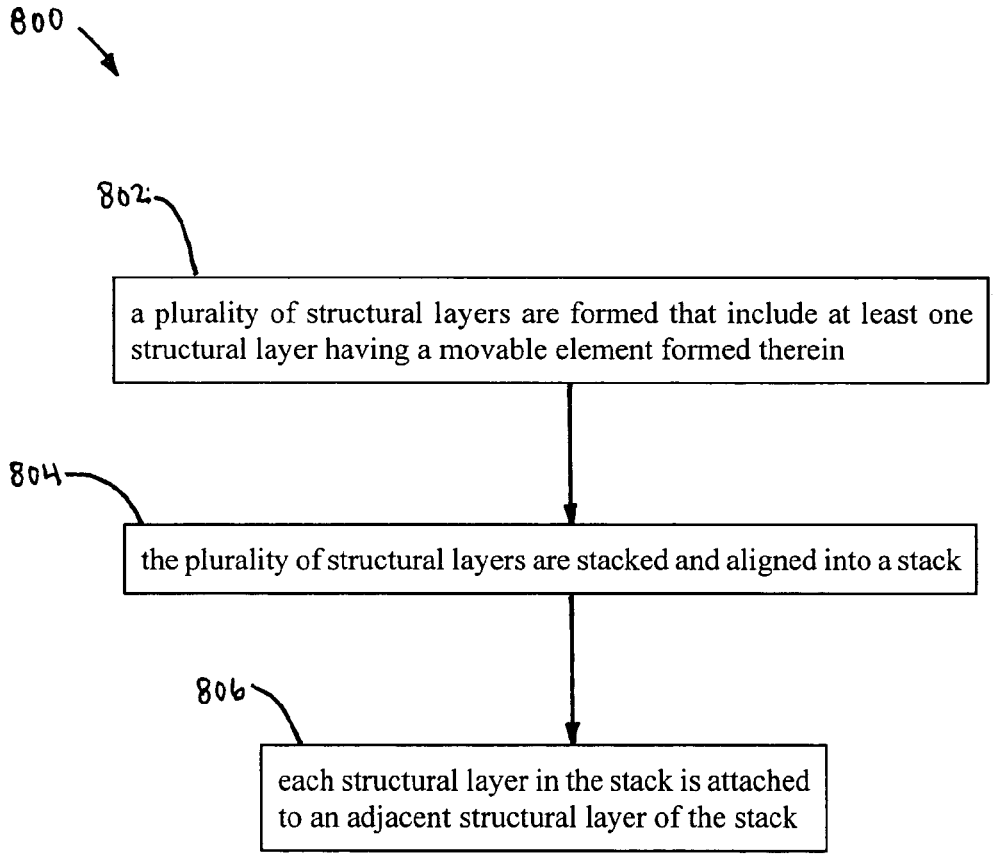
FIG. 8 shows a flowchart for making or assembling laminated electro-mechanical structures, according to an example embodiment of the present invention.

FIG. 8 shows a flowchart 800 providing steps for making micro-machined structures of the present invention. The steps of FIG. 8 do not necessarily have to occur in the order shown, as will be apparent to persons skilled in the relevant art(s) based on the teachings herein.

As described herein, numerous electrical and mechanical device types may be made according to the laminated electro-mechanical systems and structures of the present invention. These devices can be made in a wide range of sizes, including small-scale micro-mechanical devices and larger scale devices. These devices can also be made to include movable elements, such as latching switches. The following sections are provided to detail structure and operation of an example micro-mechanical latching switch that may be formed according to the laminated electro-mechanical systems and structures of the present invention. However, note that this description is provided for illustrative purposes, and the present invention is not limited to the embodiments shown therein. As described above, the present invention is applicable to numerous device types.

For example, described further below are laminated electro-mechanical system embodiments for relays having multiple flexible/moveable contacts.

Overview of a Latching Switch

Figure 9A:
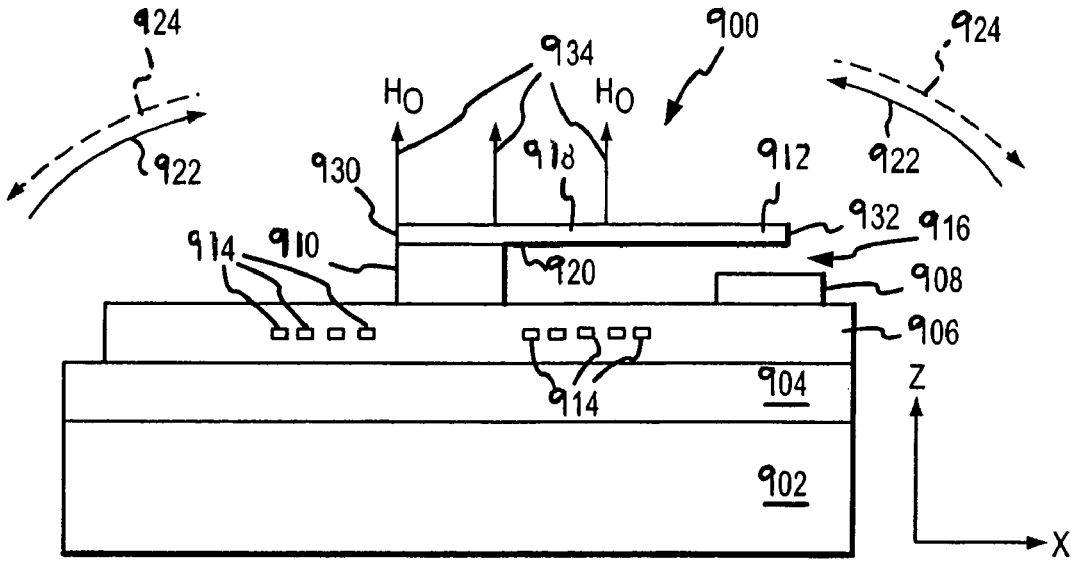
FIGS. 9A and 9B are side and top views, respectively, of an exemplary embodiment of a switch.
Figure 9B:
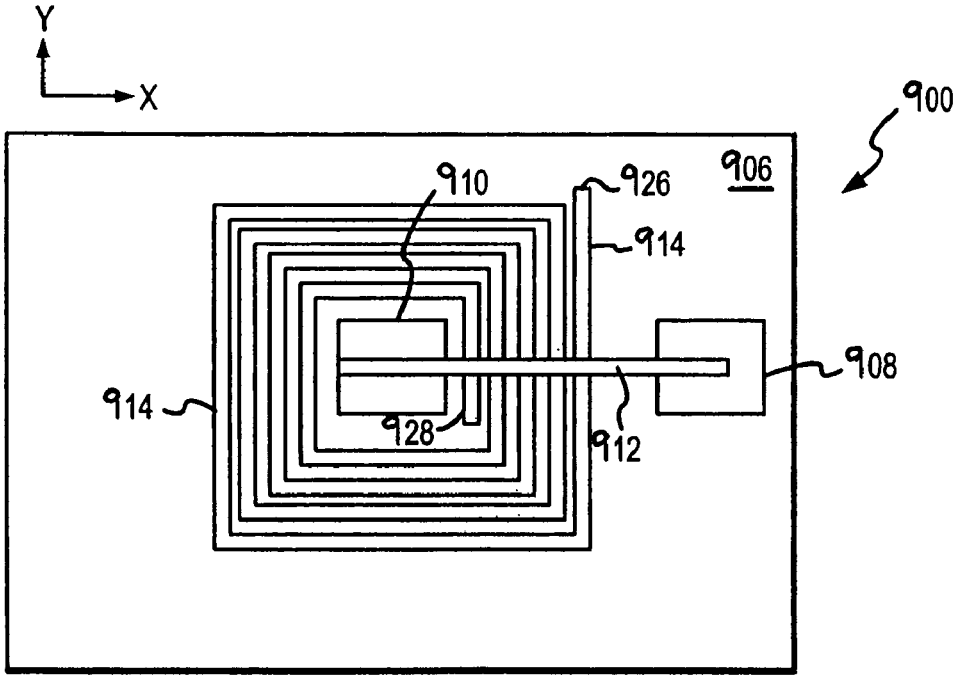

FIGS. 9A and 9B show side and top views, respectively, of a latching switch. The terms switch and device are used herein interchangeably to described the structure of the present invention. With reference to FIGS. 9A and 9B, an exemplary latching relay 900 suitably includes a magnet 902, a substrate 904, an insulating layer 906 housing a conductor 914, a contact 908 and a cantilever (moveable element) 912 positioned or supported above substrate by a staging layer 910.

Magnet 902 is any type of magnet such as a permanent magnet, an electromagnet, or any other type of magnet capable of generating a magnetic field H0 934, as described more fully below. By way of example and not limitation, the magnet 902 can be a model 59-P09213T001 magnet available from the Dexter Magnetic Technologies corporation of Fremont, Calif., although of course other types of magnets could be used. Magnetic field 934 can be generated in any manner and with any magnitude, such as from about 1 Oersted to 104 Oersted or more. The strength of the field depends on the force required to hold the cantilever in a given state, and thus is implementation dependent. In the exemplary embodiment shown in FIG. 9A, magnetic field H0 934 can be generated approximately parallel to the Z axis and with a magnitude on the order of about 370 Oersted, although other embodiments will use varying orientations and magnitudes for magnetic field 934. In various embodiments, a single magnet 902 can be used in conjunction with a number of relays 900 sharing a common substrate 904.

Substrate 904 is formed of any type of substrate material such as silicon, gallium arsenide, glass, plastic, metal or any other substrate material. In various embodiments, substrate 904 can be coated with an insulating material (such as an oxide) and planarized or otherwise made flat. In various embodiments, a number of latching relays 900 can share a single substrate 904. Alternatively, other devices (such as transistors, diodes, or other electronic devices) could be formed upon substrate 904 along with one or more relays 900 using, for example, conventional integrated circuit manufacturing techniques. Alternatively, magnet 902 could be used as a substrate and the additional components discussed below could be formed directly on magnet 902. In such embodiments, a separate substrate 904 may not be required.

Insulating layer 906 is formed of any material such as oxide or another insulator such as a thin-film insulator. In an exemplary embodiment, insulating layer is formed of Probimide 7510 material. Insulating layer 906 suitably houses conductor 914. Conductor 914 is shown in FIGS. 9A and 9B to be a single conductor having two ends 926 and 928 arranged in a coil pattern. Alternate embodiments of conductor 914 use single or multiple conducting segments arranged in any suitable pattern such as a meander pattern, a serpentine pattern, a random pattern, or any other pattern. Conductor 914 is formed of any material capable of conducting electricity such as gold, silver, copper, aluminum, metal or the like. As conductor 914 conducts electricity, a magnetic field is generated around conductor 914 as discussed more fully below.

Cantilever (moveable element) 912 is any armature, extension, outcropping or member that is capable of being affected by magnetic force. In the embodiment shown in FIG. 9A, cantilever 912 suitably includes a magnetic layer 918 and a conducting layer 920. Magnetic layer 918 can be formulated of permalloy (such as NiFe alloy) or any other magnetically sensitive material. Conducting layer 920 can be formulated of gold, silver, copper, aluminum, metal or any other conducting material. In various embodiments, cantilever 912 exhibits two states corresponding to whether relay 900 is "open" or "closed", as described more fully below. In many embodiments, relay 900 is said to be "closed" when a conducting layer 920, connects staging layer 910 to contact 908. Conversely, the relay may be said to be "open" when cantilever 912 is not in electrical contact with contact 908. Because cantilever 912 can physically move in and out of contact with contact 908, various embodiments of cantilever 912 will be made flexible so that cantilever 912 can bend as appropriate. Flexibility can be created by varying the thickness of the cantilever (or its various component layers), by patterning or otherwise making holes or cuts in the cantilever, or by using increasingly flexible materials.

Alternatively, cantilever 912 can be made into a "hinged" arrangement. Although of course the dimensions of cantilever 912 can vary dramatically from implementation to implementation, an exemplary cantilever 912 suitable for use in a micro-magnetic relay 900 can be on the order of 10–1000 microns in length, 1–40 microns in thickness, and 2–600 microns in width. For example, an exemplary cantilever in accordance with the embodiment shown in FIGS. 9A and 9B can have dimensions of about 600 microns×10 microns×50 microns, or 1000 microns×600 microns×25 microns, or any other suitable dimensions.

Contact 908 and staging layer 910 are placed on insulating layer 906, as appropriate. In various embodiments, staging layer 910 supports cantilever 912 above insulating layer 906, creating a gap 916 that can be vacuum or can become filled with air or another gas or liquid such as oil. Although the size of gap 916 varies widely with different implementations, an exemplary gap 916 can be on the order of 1–100 microns, such as about 20 microns, Contact 908 can receive cantilever 912 when relay 900 is in a closed state, as described below. Contact 908 and staging layer 910 can be formed of any conducting material such as gold, gold alloy, silver, copper, aluminum, metal or the like. In various embodiments, contact 908 and staging layer 910 are formed of similar conducting materials, and the relay is considered to be "closed" when cantilever 912 completes a circuit between staging layer 910 and contact 908. In certain embodiments wherein cantilever 912 does not conduct electricity, staging layer 910 can be formulated of non-conducting material such as Probimide material, oxide, or any other material. Additionally, alternate embodiments may not require staging layer 910 if cantilever 912 is otherwise supported above insulating layer 906.

Principle of Operation of a Latching Switch

When it is in the "down" position, the cantilever makes electrical contact with the bottom conductor, and the switch is "on" (also called the "closed" state). When the contact end is "up", the switch is "off" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 10:
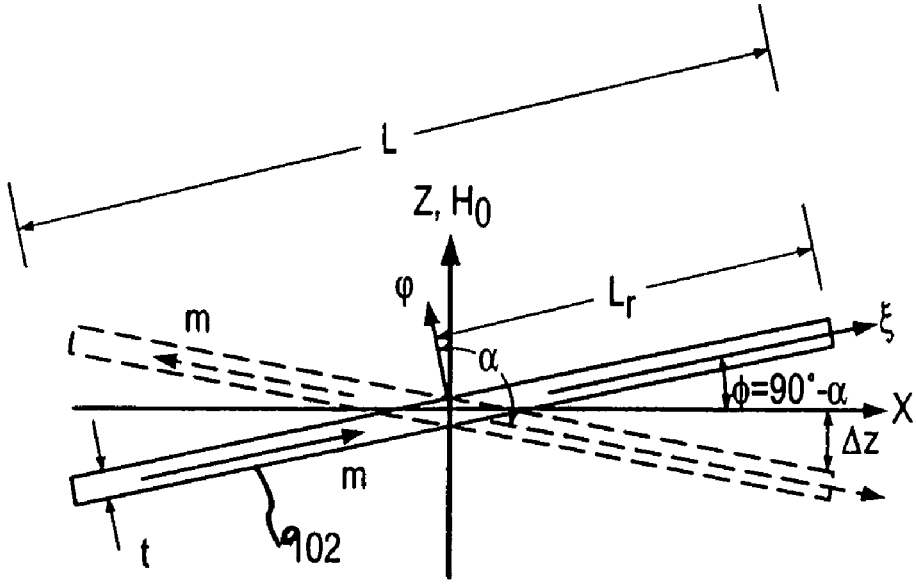
FIG. 10 illustrates the principle by which bi-stability is produced.

The principle by which bi-stability is produced is illustrated with reference to FIG. 2. When the length L of a permalloy cantilever 912 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field (H0) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 10) of the cantilever (m points from left to right when $\alpha<90°$, and from right to left when $\alpha>90°$). Due to the torque, the cantilever tends to align with the external magnetic field (H0). However, when a mechanical force (such as the elastic torque of the cantilever, a physical stopper, etc.) preempts to the total realignment with H0, two stable positions ("up" and "down") are available, which forms the basis of latching in the switch.

(ii) Electrical Switching

If the bi-directional magnetization along the easy axis of the cantilever arising from H0 can be momentarily reversed by applying a second magnetic field to overcome the influence of (H0), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 10) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [$H0\xi \sim H0\cos(\alpha)=H0\sin(\phi)$, $\alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B2\cdot n=B1\cdot n,\ B2\times n=(\mu 2/\mu 1)B1\times n$$

or $$H2\cdot n=(\mu 1/\mu 2)H1\cdot n,\ H2\times n=H1\times n$$

Figure 11:
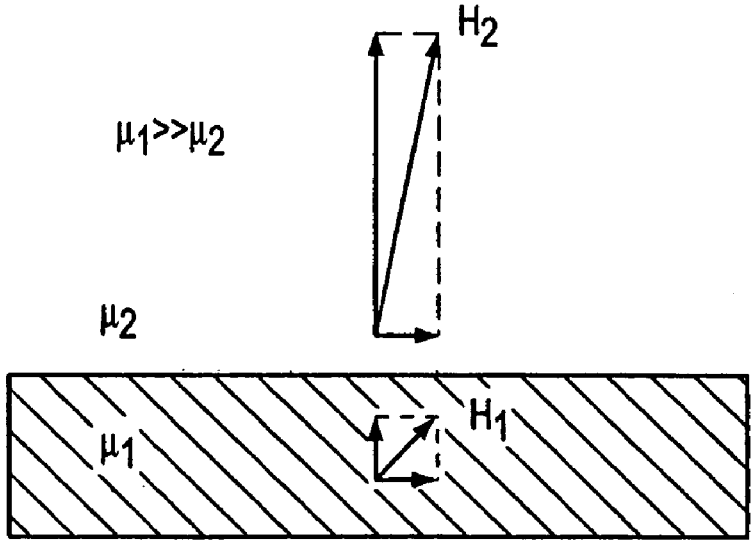
FIG. 11 illustrates the boundary conditions on the magnetic field (H) at a boundary between two materials with different permeability (1>>2).

If $\mu 1 >> \mu 2$, the normal component of H2 is much larger than the normal component of H1, as shown in FIG. 11. In the limit $(\mu 1/\mu 2)\rightarrow\infty$, the magnetic field H2 is normal to the boundary surface, independent of the direction of H1 (barring the exceptional case of H1 exactly parallel to the interface). If the second media is air ($\mu 2=1$), then $B2=\mu 0\ H2$, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

Embodiments for Laminated Relays with Multiple Movable Contacts

Described in this section are laminated electro-mechanical system (LEMS) embodiments for relays having multiple moveable/flexible contacts. Having multiple moveable/flexible contact members (i.e., cantilevers, contacts) provides many benefits, including in reducing undesired "bounce" when a cantilever comes into contact with another element. For example, bounce can occur due to an impact when a first contact initially touches a second contact. The first contact and/or second contact may actually bounce back, temporarily losing the connection between them one or more times. Bouncing is not desirable because it increases a settling time for the electrical connection, and reduces lifetime of the participating contacts (e.g., increasing a duration of arcing between the contacts).

Two and three moveable/flexible contact member embodiments are described below, for illustrative purposes. However, embodiments having more than two or three moveable/flexible contact members are also within the scope and spirit of the present invention.

In embodiments of the present invention, because the second contact (and/or additional contacts) is flexible in addition to the first contact being flexible, the impact of the first contact on the second contact is partially absorbed by the second contact. The second contact retracts with a spring-like effect, and moves together with the first contact, thereby reducing bounce, settling time, and improving reliability.

Figure 13A:
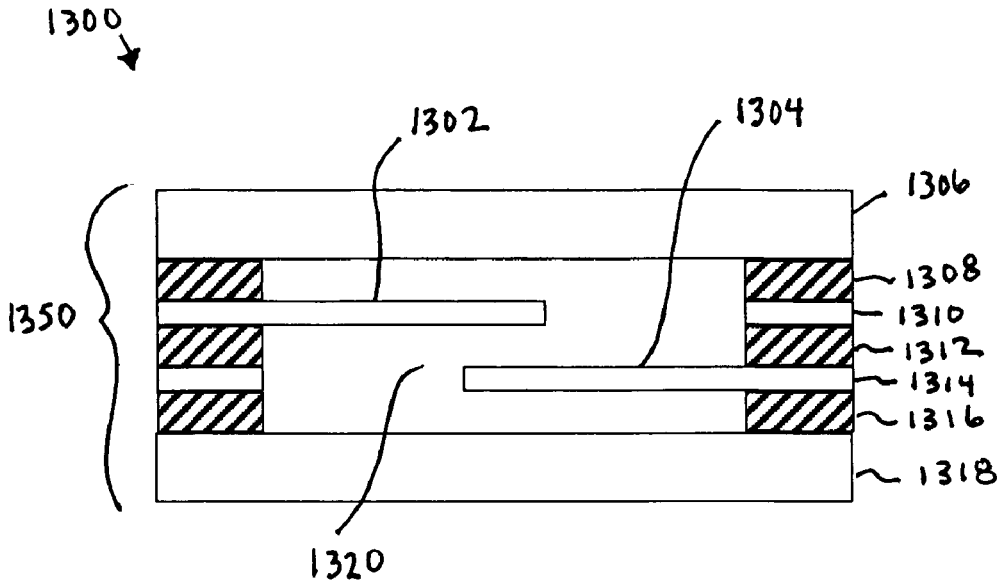
FIGS. 13A–13D show example switches having two flexible contact members, according to embodiments of the present invention.
Figure 13B:
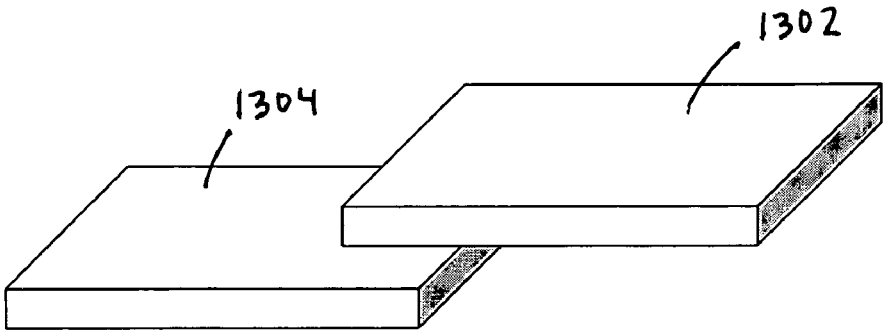
Figure 13C:
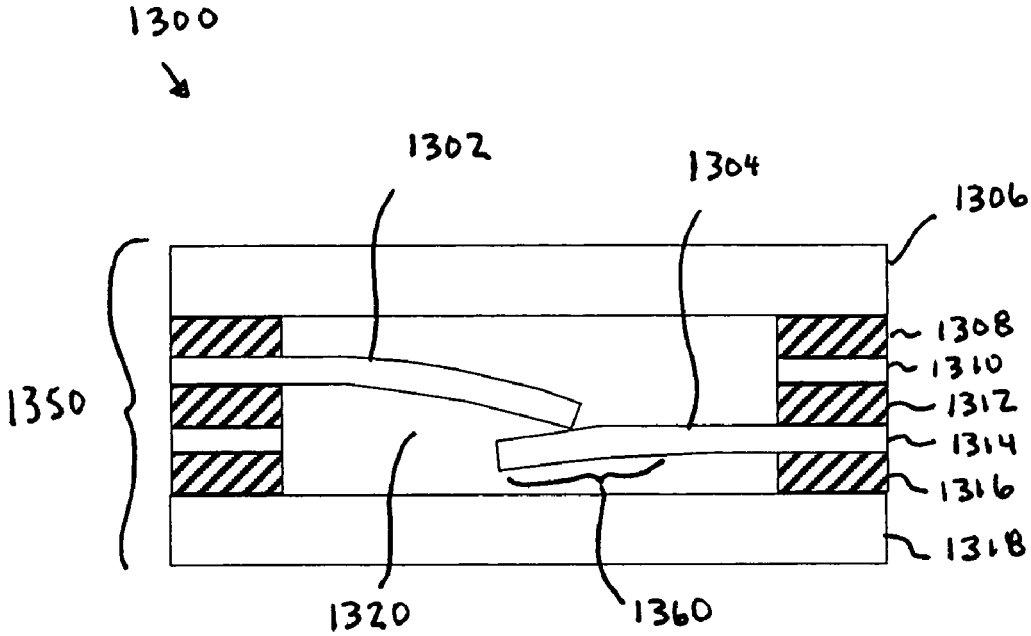

FIGS. 13A–13C relate to an example relay or switch 1300 having two flexible contact members, according to an embodiment of the present invention. FIG. 13A shows a cross-sectional view of switch 1300. As shown in FIG. 13A, switch 1300 includes a first flexible member 1302, a second flexible member 1304, a top (first) cover layer 1306, a first spacer layer 1308, a layer 1310, a second spacer layer 1312, a layer 1312, a third spacer layer 1316, and a bottom (second) cover layer 1318. These layers of switch 1300 form a stack 1350, similar to stack 116 shown in FIG. 1B. The layers of switch 1300 are attached together, such as by laminating techniques, epoxy, glue, by depositing of layers, electroplating, and/or by other techniques.

First, second, and third spacer layers 1308, 1312, and 1316 each include an opening therethrough. First, second, and third spacer layers 1308, 1312, and 1316 are similar to first and second spacer layers 106 and 110 described above with respect to FIG. 1 for LEMS 100. First, second, and third spacer layers 1308, 1312, and 1316 collectively contribute to forming a cavity 1320 in switch 1300. Cavity 1320 allows first and second flexible members 1302 and 1304 to move and/or flex freely to contact one or more electrical contacts (not shown in FIG. 13A).

Top cover layer 1306 and bottom cover layer 1318 are structural covers that cover the ends/sides of cavity 1320 within the spacer layers and other layers of switch 1300. For example, in an embodiment, top cover layer 1306 and bottom cover layer 1318 are similar to first substrate layer 104 shown in FIG. 1 for LEMS 100. When present, top cover layer 1306 and/or bottom cover layer 1318 are useful for providing environmental protection for the internal features of switch 1300, including hermetic protection, protection from dust and other particulate contaminants, etc.

In embodiments, top cover layer 1306 and/or bottom cover layer 1318 can include additional features. For example, in embodiments, top cover layer 1306 and/or bottom cover layer 1318 can include: an electromagnet, such as a coil; a magnetic material, such as a soft magnetic material (e.g. permalloy) or a permanent magnet; and electrically conductive features, such as contacts, traces, and/or vias.

In embodiments, various layers of switch 1300, including top cover layer 1306, bottom cover layer 1318, and first, second, and third spacer layers 1308, 1312, and 1316, can be made from a variety of materials. Such materials include a glass material, substrate materials, dielectrics, a plastic, a polymer, an epoxy (e.g., FR4), a metal or combination/alloy of metals (e.g., iron, steel, copper, aluminum, titanium, etc.), or other material, including suitable hermetic sealing materials, mentioned elsewhere herein, or otherwise known.

As shown in FIG. 13A, first flexible member 1302 is located in layer 1310, and second flexible member 1304 is located in layer 1314. First and second flexible members 1302 and 1304 can be made from the same, or a different material from the remainder of their respective layers 1310 and 1314. Furthermore, first and second flexible members 1302 and 1304 can be multi-layered and/or can be plated to provide electrical connectivity. FIG. 13B shows a perspective view of first and second flexible members 1302 and 1304, according to an example embodiment of the present invention (the remaining portions of layers 1310 and 1314 are not shown in FIG. 13B). In an embodiment such as shown in FIG. 13A, first and second flexible members 1302 and 1304 each extend inwardly in their respective layers from an edge of their respective layers 1310 and 1314. In another embodiment, first and/or second flexible members 1302 and 1304 may each be attached to their respective layers 1310 and 1314 through one or more hinge or flexure members. Example hinge/flexure member embodiments are described below.

Although first and second flexible members 1302 and 1304 are shown in FIG. 13A as extending inwardly from opposing sides of stack 1350, first and second flexible members 1302 and 1304 can alternatively extend inwardly from adjacent sides, or even the same side, of stack 1350.

According to various actuation mechanisms, either one of, or both of, first flexible member 1302 and second flexible member 1304 can be caused to move (i.e., be moveable) into contact with the other flexible member. Such actuation mechanisms include magnetic, electrostatic, and others. For purposes of illustration, switch 1300 is described below as having first flexible member 1302 being moveable (i.e., the "master"), while second flexible member 1304 is not moveable (i.e., the "slave"). However, it will be understood to persons skilled in the relevant arts(s) that either or both of flexible members 1302 and 1304 could be moveable.

Switch 1300 can switch between first and second stable states due to the selected actuation mechanism. FIG. 13C shows switch 1300 in a first stable state, where first flexible member 1302 has moved downward through its non-flexed horizontal plane shown in FIG. 13A into contact with second flexible member 1304. Switch 1300 is shown in an example second stable state in FIG. 13A, where first flexible member 1302 is not in contact with second flexible member 1304. In another possible second stable state, such as in a magnetically actuated switch embodiment, first flexible member 1302 may actually move further away from second flexible member 1304 than is shown in FIG. 13A, when in the second stable state.

Note that switch 1300 is described as having the moveable member move downward, for illustrative purposes. However, for the embodiments described herein, it is to be understood that the moveable member could alternatively move upward, sideways, etc., depending on the particular configuration of the moveable/flexible members of a switch.

Layers 1310 and 1314, including first and second flexible members 1302 and 1304, can have electrically conductive features formed thereon (traces, contacts, etc.), to support the electrical connection of signals by switch 1300. For example, in the first stable state, shown in FIG. 13C, an electrically conductive end portion of first flexible member 1302 touches an electrically conductive end portion of second flexible member 1304, forming a closed electrical conduction path from first flexible member 1302 to second flexible member 1304. Thus, the first stable state can be considered an "on" state for switch 1300. In this manner, switch 1300 can be used to electrically connect signals that are coupled to first and second flexible members 1302 and 1304.

Figure 13D:
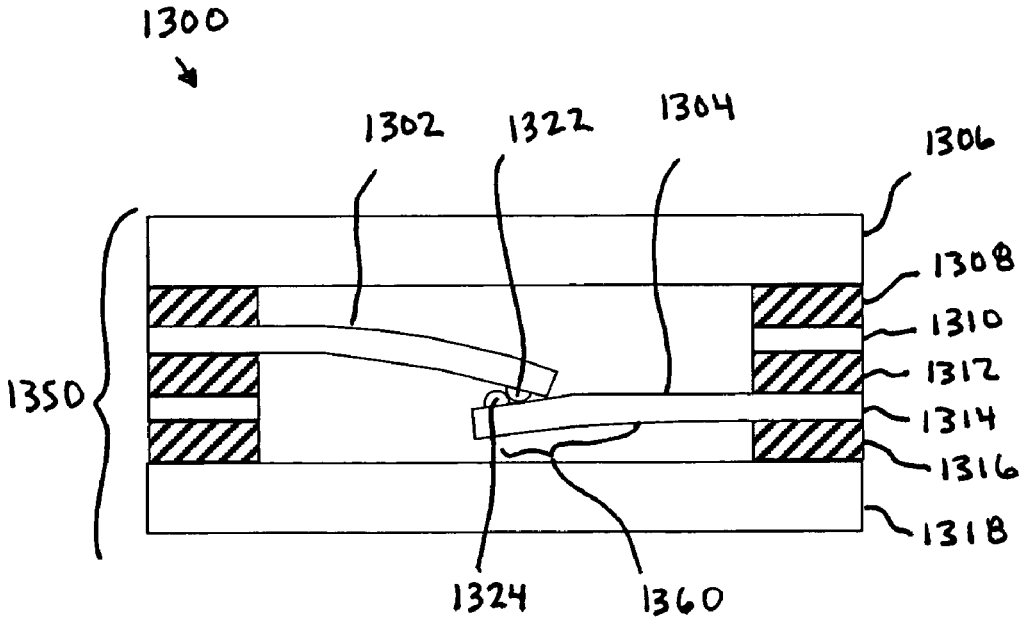

FIG. 13D shows the end portions of first and second flexible members 1302 and 1304 each having an electrically conductive contact 1322 and 1324, respectively. Electrically conductive contacts 1322 and 1324 can be any kind of electrically conductive feature. Furthermore, electrically conductive contacts 1322 and 1324 may be shaped to enhance electrical connectivity between first and second flexible members 1302 and 1304. For example, as shown in FIG. 13D, electrically conductive contacts 1322 and 1324 can be rounded, or otherwise shaped, to enhance contact. Electrically conductive contacts 1322 and 1324 can be made of any type of electrically conductive material, including a metal, or combination of metals/alloy, such as gold, silver, Rh, tin, aluminum, copper, iron, etc.

In the second stable state, such as shown in FIG. 13A, the electrically conducting end portions of first and second flexible members 1302 and 1304 are separated from each other. Thus, the second stable state can be considered an "off" state for switch 1300.

As shown in FIG. 13C, when first flexible member 1302 moves into contact with second flexible member 1304, at least an end portion 1360 of second flexible member 1304 flexes in response (if not second flexible member 1304 entirely). Second flexible member 1304 can flex because it is made from a material that can flex, and it has room to flex in cavity 1320. Because of the ability of second flexible member 1304 to flex, the impact of first flexible member 1302 on second flexible member 1304 is partially absorbed by the flexing of second flexible member 1304. Second flexible member 1304 retracts, moving together with first flexible member 1302, thereby reducing bounce, reducing settling time, and improving reliability, for switch 1300.

First flexible member 1302 and second flexible member 1304, and their respective layers 1310 and 1314, can be made from a variety of materials. Such materials include a glass material, substrate materials, dielectrics, a plastic, a polymer, an epoxy (e.g., FR4), a metal or combination/alloy of metals (e.g., iron, steel, copper, aluminum, titanium, etc.), other materials, and combinations thereof. Furthermore, in magnetically actuated embodiments, first flexible member 1302 can include a magnetic material, including a soft magnetic material such as a permalloy.

Figure 14A:
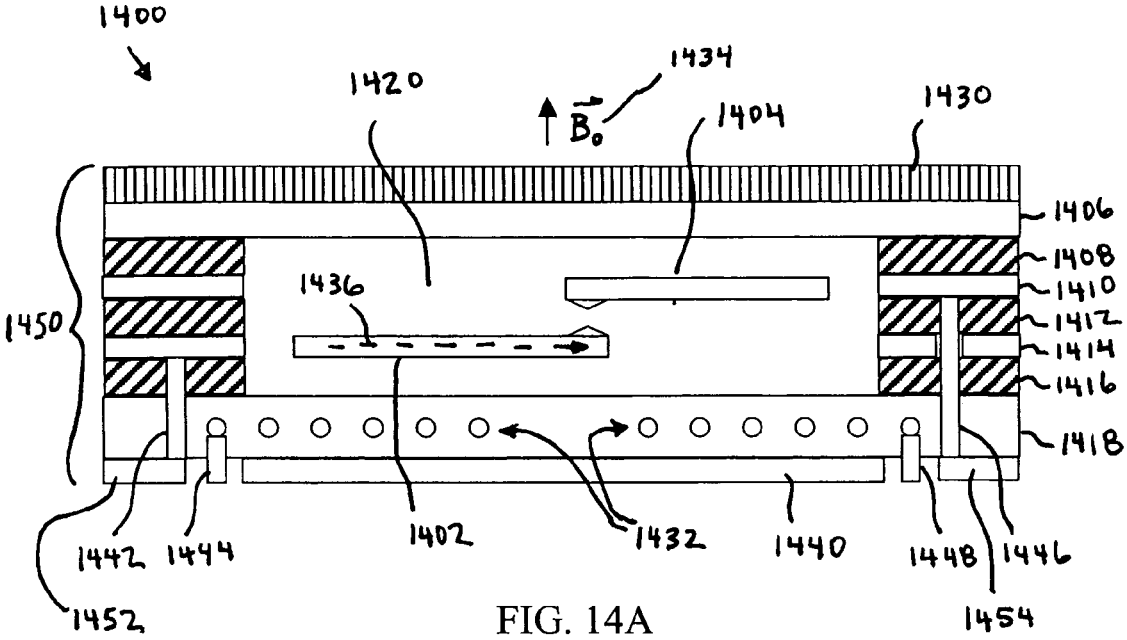
FIG. 14A shows a switch that incorporates a magnetic actuation mechanism, according to an example embodiment of the present invention.

As described above, various actuation mechanisms can be used for switch 1300. For example, FIG. 14A shows a relay or switch 1400, similar to switch 1300, that incorporates a magnetic actuation mechanism that operates as more fully described elsewhere herein, according to an example embodiment of the present invention. As shown in FIG. 14A, switch 1400 includes a first flexible member 1402, a second flexible member 1404, a top (first) cover layer 1406, a first spacer layer 1408, a layer 1410, a second spacer layer 1412, a layer 1414, a third spacer layer 1416, a bottom (second) cover layer 1418, a permanent magnetic layer 1430, and an optional soft magnetic layer 1440. These layers of switch 1400 form a stack 1450, similar to stack 1350 shown in FIG. 13A. Elements of switch 1400 named similarly to those of switch 1300 are generally structurally and operationally similar.

First, second, and third spacer layers 1408, 1412, and 1416 collectively contribute to forming a cavity 1420 in switch 1400. Cavity 1420 allows first and/or second flexible members 1402 and 1404 to move and/or flex freely to contact each other, and to move away from each other. Top cover layer 1406 and bottom cover layer 1418 are structural covers that cover the ends/sides of cavity 1420 within the spacer layers and other layers of switch 1400.

In the present magnetic actuation embodiment, first flexible member 1402 includes a soft magnetic material, such as a permalloy (similarly to magnetic layer 918 of cantilever 912, described above). Permanent magnet layer 1430 produces a magnetic field 1434, similar to magnetic field $H_0$ 934 produced by permanent magnet 902, shown in FIG. 9A. As described above for magnetic field H0 934, magnetic field 1434 induces a magnetization in the soft magnetic material of first flexible member 1402. The magnetization is characterized by a magnetization vector pointing in a direction along a longitudinal axis 1436 of first flexible member 1402. As shown in FIG. 14A, magnetic field 1434 is approximately perpendicular to longitudinal axis 1436.

Bottom cover layer 1418 includes a conductor, such as coil 1432, which is similar to conductor 914. Coil 1432 is capable of producing a second magnetic field to cause first flexible member 1402 to switch between the first stable state ("on" state, moved in contact with second flexible member 1404) and the second stable state ("off" state, moved away from second flexible member 1404). In the first stable state, first flexible member 1402 is in contact with second flexible member 1404, which flexes in response, similarly to as shown for second flexible member 1304 shown in FIG. 13C. As described above, flexing of second flexible member 1404 thereby reduces bounce, reduces settling time, and improves reliability, for switch 1400.

Optional soft magnetic layer 1440 (also referred to as a "dipole layer"), when present, is used to relax the permanent magnet alignment requirement, as described above. Soft magnetic layer 1440 can be a permalloy or other soft magnetic material.

Switch 1400 can include a plurality of electrically conductive vias to couple internal signals to other internal signals and/or to externally accessible contacts. For example, an electrically conductive via 1442 couples layer 1414 to an externally accessible contact 1452. Thus, in an embodiment, first flexible member 1402 can be coupled to an external signal present at externally accessible contact 1452 through layer 1414 and electrically conductive via 1442.

Furthermore, an electrically conductive via 1446 couples layer 1410 to an externally accessible contact 1454. Thus, in an embodiment, second flexible member 1404 can be coupled to an external signal present at externally accessible contact 1454 through layer 1410 and electrically conductive via 1446.

Furthermore, as shown in FIG. 14A, a first end of coil 1432 is coupled by an electrically conductive via 1444 to an internal signal and/or an externally accessible contact. A second end of coil 1432 is coupled by an electrically conductive via 1448 to an internal signal and/or an externally accessible contact.

Second flexible member 1404 can be made from a variety of materials, including a magnetic material (e.g., permalloy) or a non-magnetic material (e.g., a metal such as beryllium copper, or other material). For example, second flexible member 1404 can be made from flexible materials such as a substrate material, polymer, plastic, epoxy, dielectric material, and/or other materials described herein or otherwise known.

Note that the positions in stack 1450 of permanent magnetic layer 1430, coil 1432, and soft magnetic layer 1440 are provided for illustrative purposes, and are not limiting. It will be understood to persons skilled in the relevant art(s) from the teachings herein that permanent magnetic layer 1430, coil 1432, and soft magnetic layer 1440 can each be positioned above or below cavity 1420, in numerous combinations.

Figure 14B:
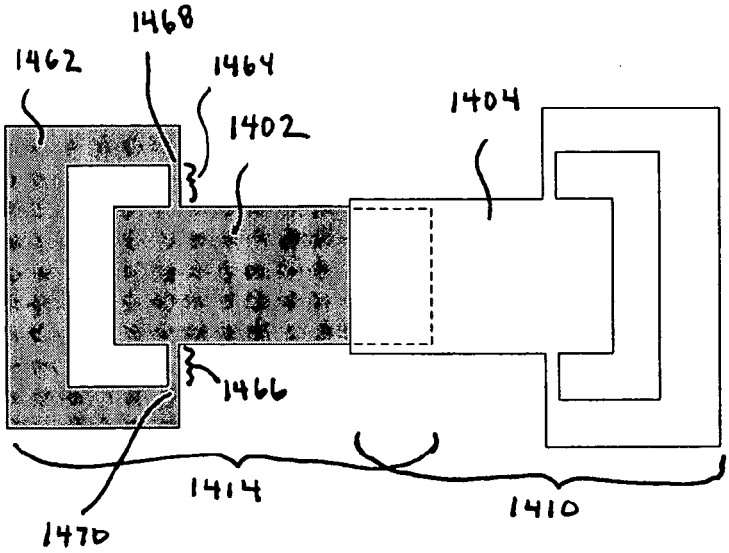
FIG. 14B shows a plan view of portions of layers of the switch of FIG. 14A, according to an example embodiment of the present invention.

FIG. 14B shows a plan view of portions of layers 1410 and 1414 of switch 1400, according to an example embodiment of the present invention. First and second flexible members 1402 and 1404 are configured in example rotating cantilever configurations, according to example embodiments of the present invention. The rotating cantilever configurations shown in FIG. 14B for first and second flexible members 1402 and 1404 can be used with any of the switch embodiments described herein, although other configurations can alternatively be used. Layer 1410 is described in further detail as follows. The following description of layer 1410 is also applicable to layer 1414.

Layer 1410 includes a U-shaped portion 1462, a first flexure member 1464, a second flexure member 1466, and first flexible member 1402. U-shaped portion 1462 anchors or supports first flexible member 1402 by being held between layers of stack 1450. In the embodiment of FIG. 14B, first and second flexure members 1464 and 1466 are located opposite each other, and their axes are aligned, although in other embodiments they may be positioned differently. First flexure member 1464 is coupled between a first inner end portion 1468 of U-shaped portion 1462 and a first side of flexible member 1402. Second flexure member 1466 is coupled between a second inner end portion 1470 of U-shaped portion 1462 and a second side of flexible member 1402. First and second flexure members 1464 and 1466 rotationally/torsionally flex around their axes when first flexible member 1402 moves according to the magnetic actuation mechanism.

Note that in an alternative embodiment, U-shaped portion 1462 of layer 1414 can alternatively be a ring shaped portion, which extends substantially, including completely, around first flexible member 1402 in switch 1400, to give greater support to first flexible member 1402. Furthermore, other equivalent configurations are envisioned.

Figure 15A:
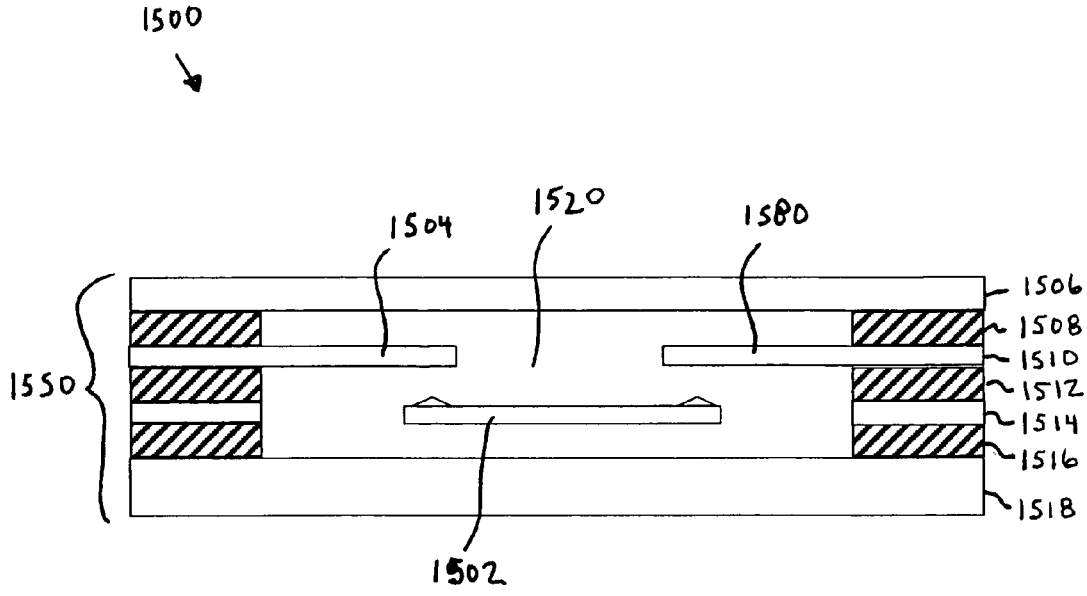
FIGS. 15A–15C show views of a switch having three flexible contact members, according to an embodiment of the present invention.
Figure 15B:
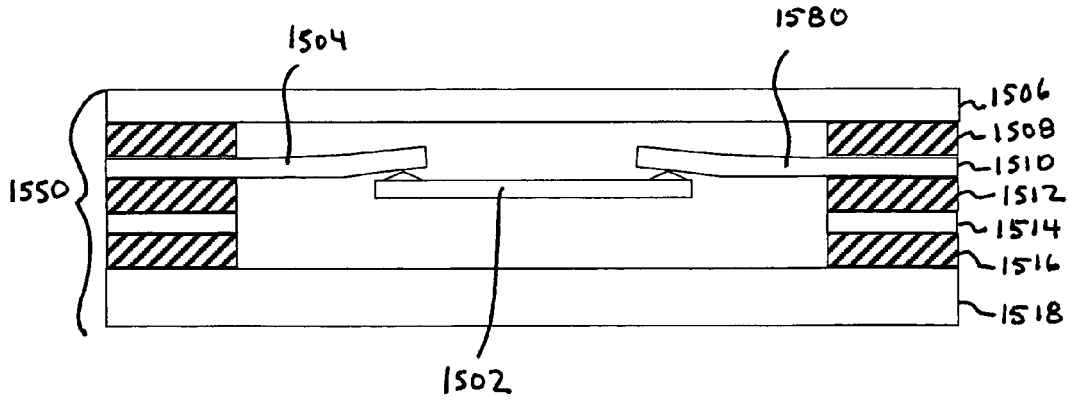

As described above, switches can have more than two moveable/flexible members, in embodiments of the present invention. For example, FIGS. 15A–15C relate to a switch 1500 similar to switch 1300, having an additional third flexible member, according to an embodiment of the present invention. FIG. 15B shows switch 1500 in the "off" or second stable state. As shown in FIG. 15A, switch 1500 is similar to switch 1300. As shown in FIG. 15A, switch 1500 includes a top (first) cover layer 1506, a first spacer layer 1508, a layer 1510, a second spacer layer 1512, a layer 1514, a third spacer layer 1516, a bottom (second) cover layer 1518. These layers of switch 1500 form a stack 1550, similar to stack 1350 shown in FIG. 13A. Layer 1514 includes a first flexible member 1502, similarly to layer 1314, which includes first flexible member 1302, as shown in FIG. 13A. However, layer 1510 includes two flexible members, a second flexible member 1504 and a third flexible member 1580.

Figure 15C:
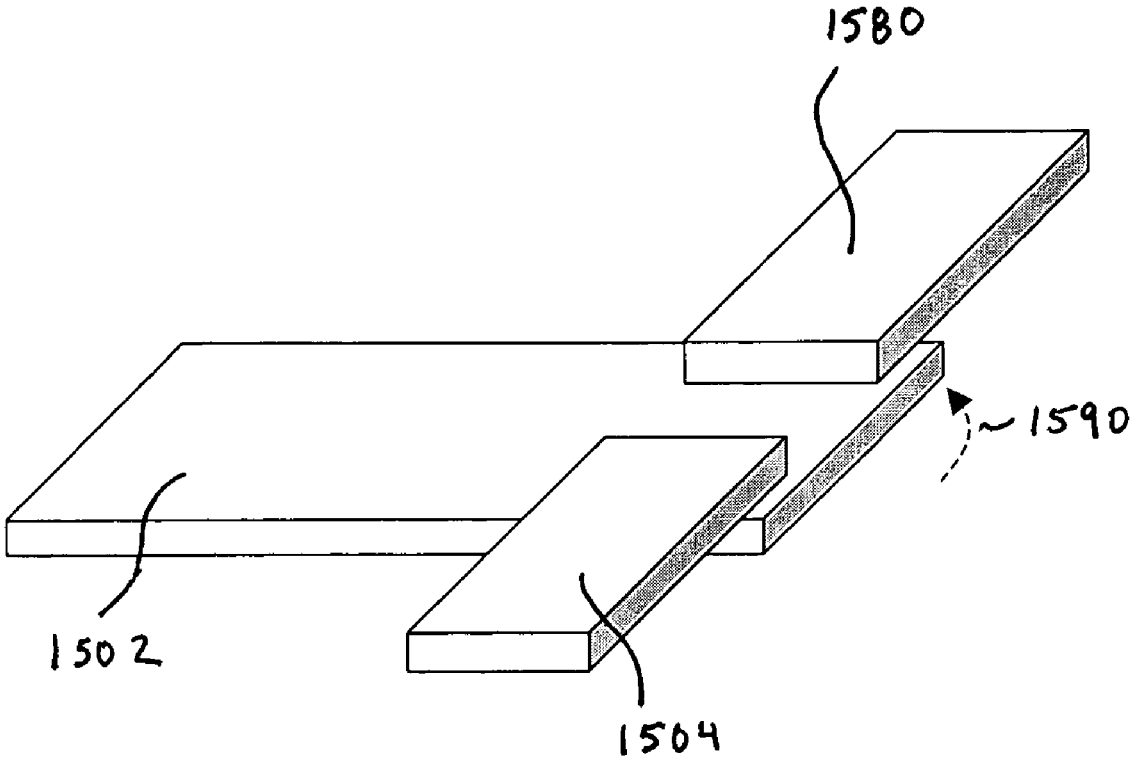

FIG. 15C shows a perspective view of first, second, and third flexible members 1502, 1504, and 1580 of switch 1500, according to an example embodiment of the present invention. When actuated, an end of first flexible member 1502 moves/rotates upward above the horizontal plane of layer 1514, as indicated by arrow 1590 in FIG. 15C. As shown in FIG. 15B, first flexible member 1502 contacts second and third flexible members 1502 and 1580, which both flex in response. Because of the ability of second and third flexible members 1504 and 1580 to flex, the impact of first flexible member 1502 on second and third flexible members 1504 and 1580 is partially absorbed by the flexing of second and third flexible members 1504 and 1580. Second and third flexible members 1504 and 1580 retract with a spring-like effect, moving together with first flexible member 1502, thereby reducing bounce, reducing settling time, and improving reliability, for switch 1500.

Furthermore, an electrically conductive end portion of first flexible member 1502 touches an electrically conductive end portion of second flexible member 1504 and an electrically conductive end portion of third flexible member 1580, forming a closed electrical conduction path between second and third flexible members 1504 and 1580 through first flexible member 1502. Thus, the first stable state shown in FIG. 15B can be considered an "on" state for switch 1500. In this manner, switch 1500 can be used to electrically connect signals that are coupled to second and third flexible members 1504 and 1580.

In the second stable state, such as shown in FIG. 15A, the electrically conductive end portions of second and third flexible members 1504 and 1580 are not coupled together by first flexible member 1502. Thus, the second stable state can be considered an "off" state for switch 1500.

As shown in FIGS. 15A–15C, in an embodiment, second and third flexible members 1504 and 1580 can be located opposite each other in switch 1500. First flexible member 1502 is shown located perpendicular to an imaginary axis through second and third flexible members 1504 and 1580. In alternative embodiments, first, second, and third flexible members 1502, 1504, and 1580 can be arranged in other ways. For example, second and third flexible members 1504 and 1580 can be located perpendicular to each other, or adjacent to each other on the same side of switch 1500. Furthermore, first flexible member 1502 can be located opposite of either or both of second and third flexible members 1504 and 1580.

Note that second and third flexible members 1504 and 1580 can be made from magnetic materials (e.g., permalloy) or non-magnetic materials (e.g., a metal such as beryllium copper or other electrically conducting material). For example, second and third flexible members 1504 and 1580 can be made from flexible materials such as a substrate material, polymer, plastic, epoxy, dielectric material, and/or other materials described herein or otherwise known.

Figure 16A:
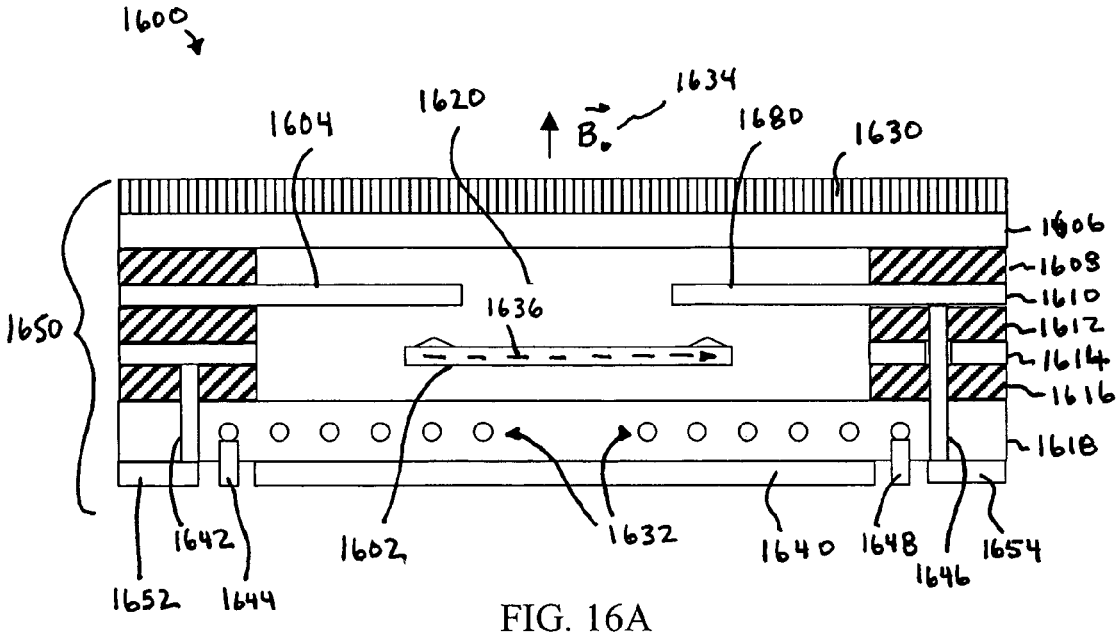
FIGS. 16A and 16B show views of a switch similar to the switch of FIGS. 15A–15C that incorporates a magnetic actuation mechanism, according to an example embodiment of the present invention.

FIG. 16A shows a relay or switch 1600, similar to switch 1500, that incorporates a magnetic actuation mechanism similar to that of switch 1400 shown in FIG. 14A, according to an example embodiment of the present invention. As shown in FIG. 16A, switch 1600 includes a first flexible member 1602, a second flexible member 1604, a top (first) cover layer 1606, a first spacer layer 1608, a layer 1610, a second spacer layer 1612, a layer 1614, a third spacer layer 1616, a bottom (second) cover layer 1618, a permanent magnetic layer 1630, an optional soft magnetic layer 1640, and a third flexible member 1680. These layers of switch 1600 form a stack 1650, similar to stack 1350 shown in FIG. 13A. The operation of switch 1600 will be apparent to persons skilled in the relevant art(s) from the teachings herein, including the description above related to switches 1400 and 1500.

Figure 16B:
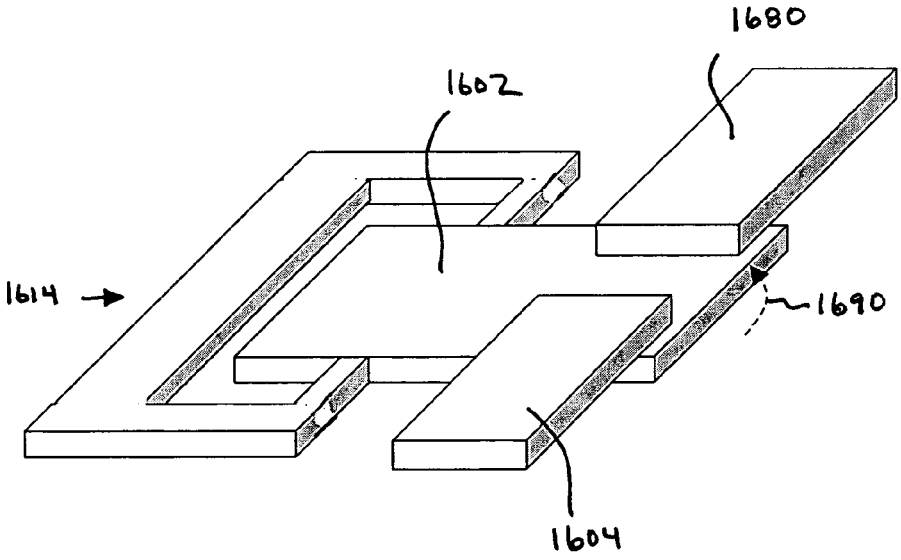

FIG. 16B shows a perspective view of first, second, and third flexible members 1602, 1604, and 1680, according to an example embodiment of the present invention. As shown in the example of FIG. 16B, first flexible member 1602 in layer 1614 is configured similarly to first flexible member 1402, as shown in FIG. 14B.

Figure 17A:
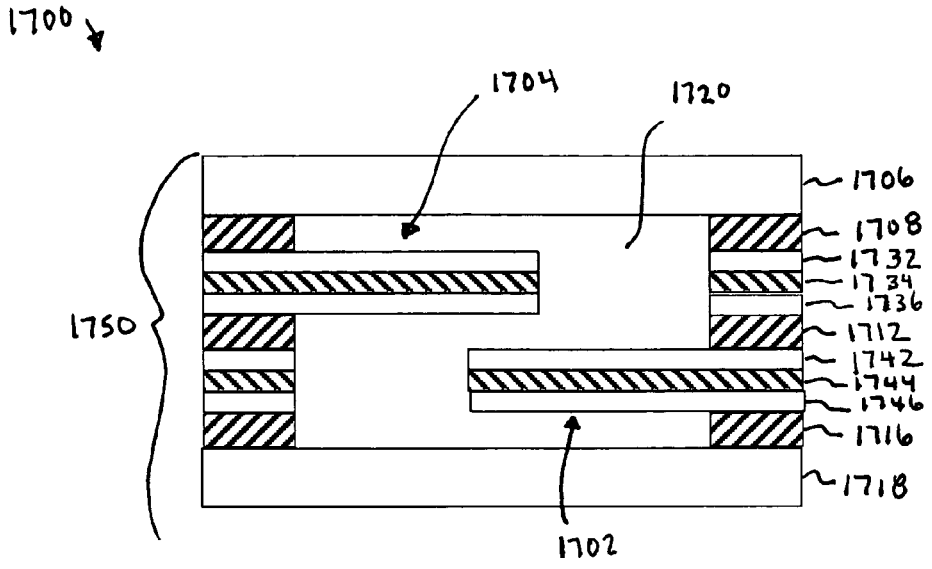
FIGS. 17A and 17B shows views of a switch, according to an example embodiment of the present invention

FIG. 17A shows a relay or switch 1700, similar to switch 1300 shown in FIG. 13, according to an example embodiment of the present invention. As shown in FIG. 17A, switch 1700 includes a first flexible member 1702, a second flexible member 1704, a top (first) cover layer 1706, a first spacer layer 1708, a first electrically conductive layer 1732, a first dielectric layer 1734, a second electrically conductive layer 1736, a second spacer layer 1712, a third electrically conductive layer 1742, a second dielectric layer 1744, a soft magnetic layer 1746, a third spacer layer 1716, and a bottom (second) cover layer 1718. These layers of switch 1700 form a stack 1750, similar to stack 1350 shown in FIG. 13A.

As shown in FIG. 17A, first flexible member 1702 and second flexible member 1704 include multiple layers of stack 1750. First flexible member 1702 includes a portion of third electrically conductive layer 1742, second dielectric layer 1744, and soft magnetic layer 1746. Dielectric layer 1766 is located between third electrically conductive layer 1742 and soft magnetic layer 1746 to provide electrical isolation. Second flexible member 1704 includes a portion of first electrically conductive layer 1732, first dielectric layer 1734, and second electrically conductive layer 1736. Second dielectric layer 1772 is located between second and third electrically conductive layers 1768 and 1770 to provide electrical isolation.

First, second, and third electrically conductive layers 1732, 1736, and 1742 can be made from any suitable electrically conductive material, such as a metal or combination of metals/alloy, including aluminum, copper, gold, silver, rhodium, tin, etc. These layers can be uniformly made from the electrically conductive material, or contain features (e.g., traces, contacts, etc.) made from the electrically conductive material. These layers can be formed in any manner, including deposition, electro-plating, lamination techniques, etc.

Due to soft magnetic layer 1746, first flexible member 1702 is useful in a magnetically actuated switch embodiment. In such an embodiment, soft magnetic layer 1746 operates as the magnetic material of the cantilever. Further details of a magnetically actuated switch embodiment are described above, for example, with respect to switch 1400 (shown in FIG. 14A).

Furthermore, in an embodiment, either or both of soft magnetic layer 1746 and electrically conductive layer 1732 can be coupled to a potential, such as a ground potential, to serve as a ground or other potential plane for switch 1700. Thus, the configuration of switch 1700 can provide advantages in providing a better ground (or other potential) connection, reducing noise, switching spikes, etc. In a radio frequency signal embodiment for switch 1700, electrically conductive plane layer 1732 and/or soft magnetic layer 1746 can operate as a line of a RF transmission line, while the path through second and third flexible members 1804 and 1880, and electrically conductive layer 1836, form the other line. Alternatively, other RF transmission lines (e.g., co-planar type, etc.) can be formed on the same electrically conductive layer.

Figure 17B:
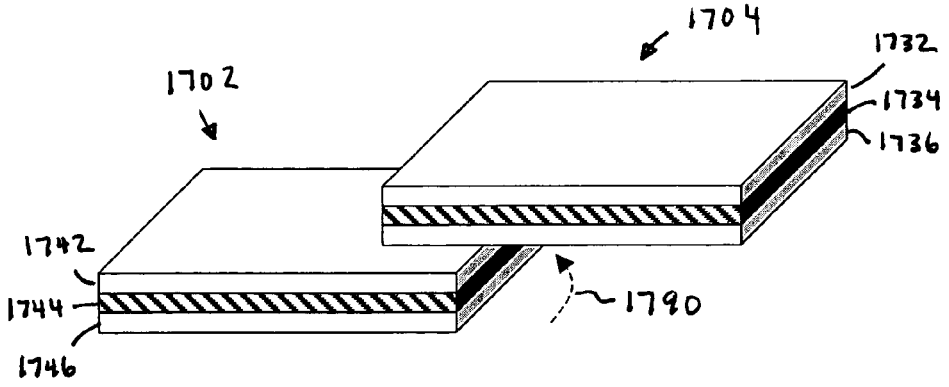

FIG. 17B shows a perspective view of first and second flexible members 1702 and 1704. As indicated by arrow 1790 in FIG. 17B, first flexible member 1702 moves/rotates upward past horizontal to contact second flexible member 1704, when actuated. As described herein, second flexible member 1704 flexes in response. When first and second flexible members 1702 and 1704 are in contact, electrically conductive layers 1742 and 1736 contact each other. During operation of switch 1700, electrically conductive layers 1742 and 1736 are coupled to signals that become electrically coupled when switch 1700 is "on". When switch 1700 is "off", electrically conductive layers 1742 and 1736 are not in contact, and thus the signals are not coupled together, and an open circuit exits.

Figure 18A:
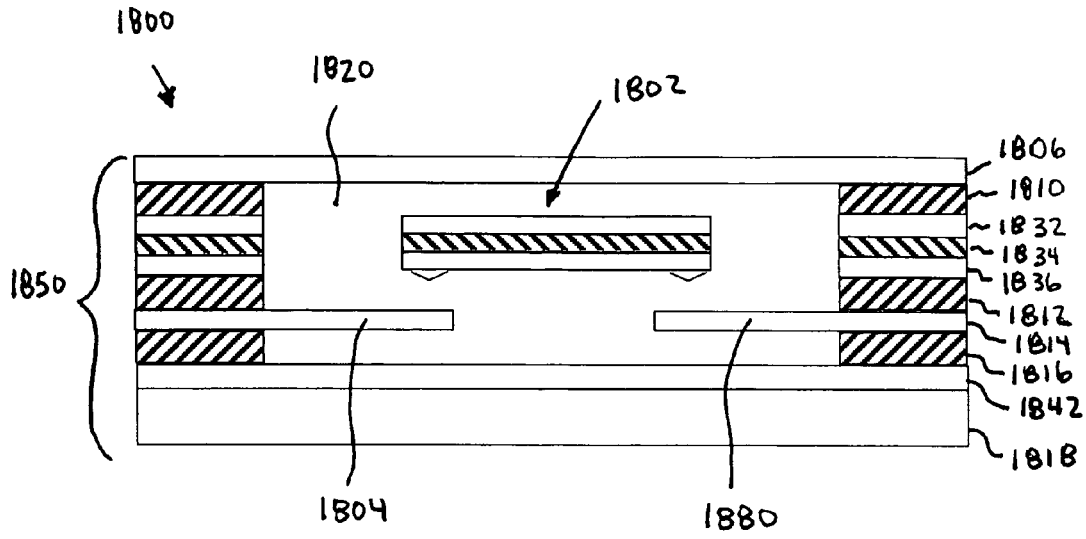
FIGS. 18A and 18B show views of a switch having three flexible contact members, according to an embodiment of the present invention.

FIG. 18A relates to a switch 1800, having an additional third flexible member similarly to switch 1500, with features of the multi-layer cantilevers of switch 1700, according to an embodiment of the present invention. FIG. 18A shows switch 1800 in the "off" or second stable state. As shown in FIG. 15A, switch 1800 includes a top (first) cover layer 1806, a first spacer layer 1808, a soft magnetic layer 1832, a dielectric layer 1834, an electrically conductive layer 1836, a second spacer layer 1812, a layer 1814, a third spacer layer 1816, an optional electrically conductive plane layer 1842, and a bottom (second) cover layer 1818. These layers of switch 1800 form a stack 1850, similar to stack 1550 shown in FIG. 15A.

As shown in FIG. 18A, first flexible member 1802 includes multiple layers of stack 1850. First flexible member 1802 includes a portion of electrically conductive layer 1836, second dielectric layer 1834, and soft magnetic layer 1832. Due to soft magnetic layer 1832, first flexible member 1802 is useful in a magnetically actuated switch embodiment. In such an embodiment, soft magnetic layer 1832 operates as the magnetic material of the cantilever. Further details of a magnetically actuated switch embodiment are described above, for example, with respect to switch 1400 (shown in FIG. 14A).

Figure 18B:
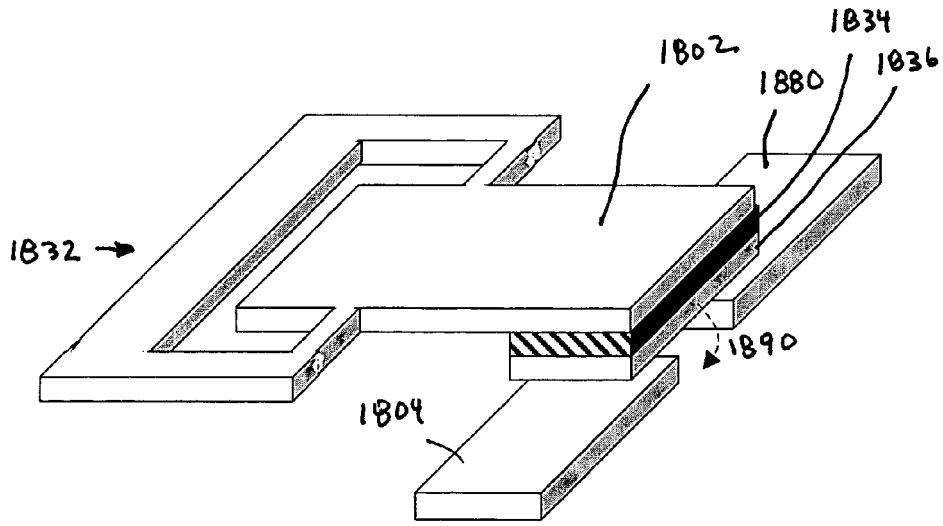

FIG. 18B shows a perspective view of first, second, and third flexible members 1802, 1804, and 1880 of switch 1800, according to an example embodiment of the present invention. When actuated, an end of first flexible member 1802 moves/rotates downward, as indicated by arrow 1890, below its (un-rotated) horizontal plane, which is shown in FIG. 18B. Similarly to as shown in FIG. 15B for switch 1500, in the first stable state for switch 1800, first flexible member 1802 contacts second and third flexible members 1804 and 1880, which both flex in response. Because of the ability of second and third flexible members 1804 and 1880 to flex, the impact of first flexible member 1802 on second and third flexible members 1804 and 1880 is partially absorbed by the flexing of second and third flexible members 1804 and 1880. Second and third flexible members 1804 and 1880 retract, moving together with first flexible member 1802, thereby reducing bounce, reducing settling time, and improving reliability, for switch 1800.

Furthermore, electrically conductive layer 1836 of first flexible member 1802 touches an electrically conductive end portion of second flexible member 1804 and an electrically conductive end portion of third flexible member 1880, forming a closed electrical conduction path between second and third flexible members 1804 and 1880 through electrically conductive layer 1836. Thus, the first stable state shown in FIG. 18B can be considered an "on" state for switch 1800. In this manner, switch 1800 can be used to electrically connect signals that are coupled to second and third flexible members 1804 and 1880.

In the second stable state, such as shown in FIG. 18A, the electrically conductive end portions of second and third flexible members 1804 and 1880 are not coupled together by electrically conductive layer 1836. Thus, the second stable state can be considered an "off" state for switch 1800.

Electrically conductive plane layer 1842 is optionally present. When present, electrically conductive plane layer 1842 can be coupled to a potential, such as a ground potential, to operate as a ground plane or other potential plane for switch 1800. Similarly, soft magnetic layer 1832 can be coupled to a potential, such as a ground potential. Thus, the configuration of switch 1800 can provide advantages in providing a better ground (or other potential) connection, reducing noise, switching spikes, etc. In a radio frequency signal embodiment for switch 1800, electrically conductive plane layer 1842 and/or soft magnetic layer 1832 can operate as one line of a RF transmission line, while the path through second and third flexible members 1804 and 1880, and electrically conductive layer 1836, form the other line. Alternatively, other RF transmission lines (e.g., co-planar type, etc.) can be formed on the same electrically conductive layer.

Figure 19A:
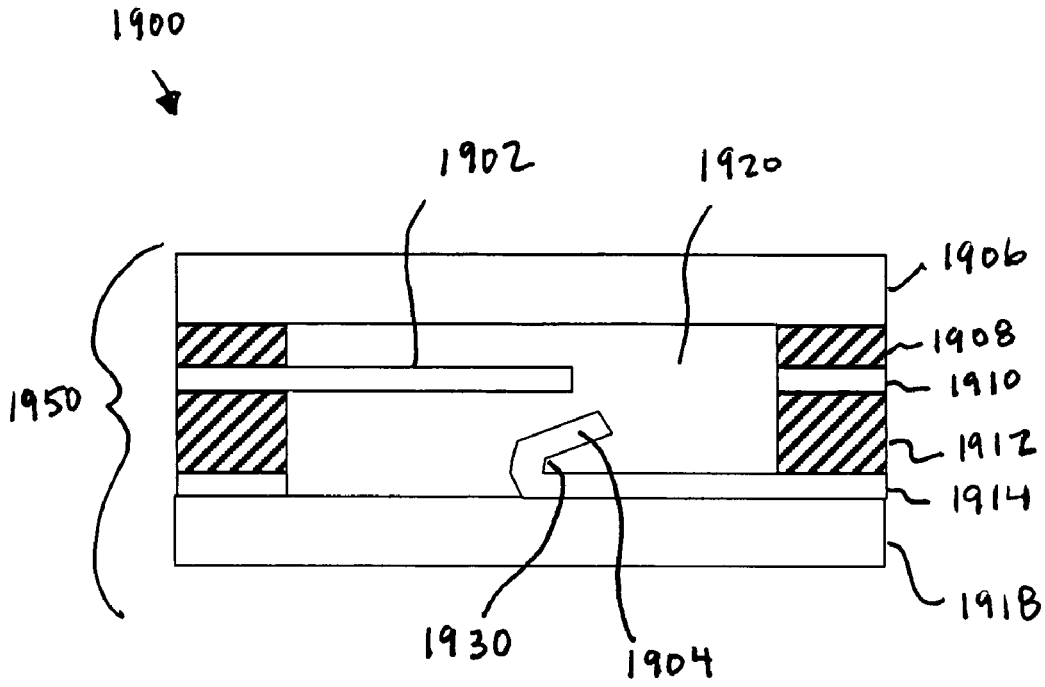
FIGS. 19A and 19B show views of a switch having a bent layer with flexible contact member, according to an example embodiment of the present invention.

FIG. 19A shows a relay or switch 1900, similar to switch 1300 shown in FIG. 13, according to an example embodiment of the present invention. As shown in FIG. 19A, switch 1900 includes a first flexible member 1902, a second flexible member 1904, a top (first) cover layer 1906, a first spacer layer 1908, a layer 1910, a second spacer layer 1912, a layer 1914, and a bottom (second) cover layer 1918. These layers of switch 1900 form a stack 1950, similar to stack 1350 shown in FIG. 13A.

As shown in FIG. 19A, a bend 1930 is present in layer 1914. Second flexible member 1904 is a "bent" or curled portion of layer 1914 that provides for flex. Bend 1930 forms an acute angle between second flexible member 1904 and the rest of layer 1914. Alternatively, in another embodiment, bend 1930 can form an obtuse angle between second flexible member 1904 and the rest of layer 1914. Note that in an alternative embodiment, layer 1910 can instead include bend 1930 (so that first flexible member 1902 is bent), or both of layers 1910 and 1914 can include a bend 1930.

Figure 19B:
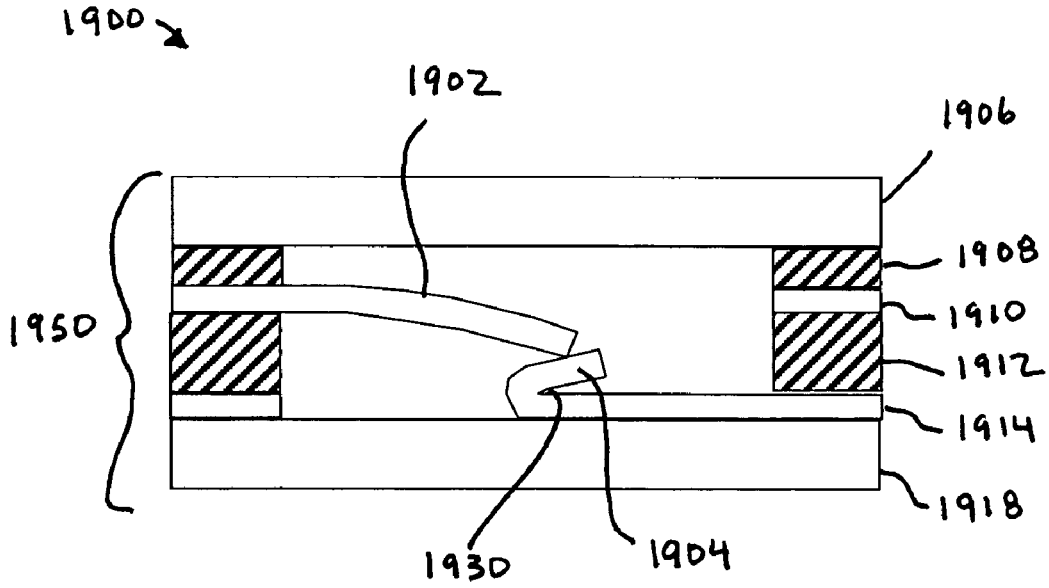

FIG. 19B shows switch 1900 in a first stable state, where first flexible member 1902 has moved into contact with second flexible member 1904, according to an example embodiment of the present invention. Switch 1900 is in an example second stable state in FIG. 19A, where first flexible member 1902 is not in contact with second flexible member 1904. In another possible second stable state, such as in a magnetically actuated switch embodiment, first flexible member 1902 may actually move further away from second flexible member 1904 than is shown in FIG. 19A, when in the second stable state.

As shown in FIG. 19B, when first flexible member 1902 moves into contact with second flexible member 1904, second flexible member 1904 flexes in response. As shown in FIG. 19B, bend 1930 forms a smaller angle in layer 1914 due to the flex compared with FIG. 19A. Second flexible member 1904 can flex because it is made from a material that can flex, and it has room to flex in cavity 1920. Because of the ability of second flexible member 1904 to flex, the impact of first flexible member 1902 on second flexible member 1904 is partially absorbed by the flexing of second flexible member 1904. Second flexible member 1904 retracts with a spring-like effect, moving together with first flexible member 1902, thereby reducing bounce, reducing settling time, and improving reliability, for switch 1900.

Figure 20:
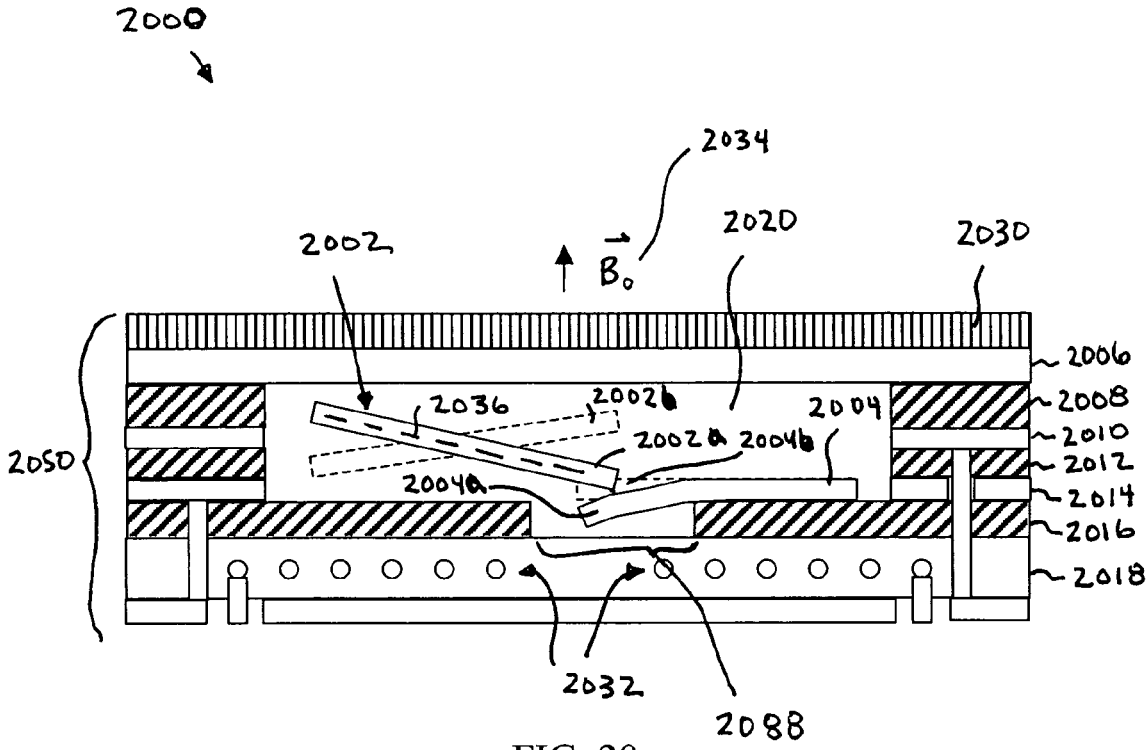
FIG. 20 shows a switch incorporating a magnetic actuation mechanism, according to an example embodiment of the present invention.

FIG. 20 shows a relay or switch 2000, similar to switch 1400, that incorporates a magnetic actuation mechanism that operates as more fully described elsewhere herein, according to an example embodiment of the present invention. As shown in FIG. 20, switch 2000 includes a first flexible member 2002, a second flexible member 2004, a top (first) cover layer 2006, a first spacer layer 2008, a layer 2010, a second spacer layer 2012, a layer 2014, a third spacer layer 2016, a bottom (second) cover layer 2018, a permanent magnetic layer 2030, and an optional soft magnetic layer 2040. These layers of switch 2000 form a stack 2050, similar to stack 1450 shown in FIG. 14A. Elements of switch 2000 named similarly to those of switch 1300 are generally structurally and operationally similar.

Coil 2032 is capable of producing a second magnetic field to cause first flexible member 2002 to switch between the first stable state ("on" state, moved in contact with second flexible member 2004), indicated as position 2002*a* in FIG. 20, and the second stable state ("off" state, moved away from second flexible member 2004), indicated as position 2002*b*. In the first stable state, first flexible member 2002 is in contact with second flexible member 2004, which flexes in response. Note that as indicated in FIG. 20, third spacer layer 2016 can include an opening 2088, which is smaller than openings in first and second spacer layers 2008 and 2012. An end of second flexible member 2004 flexes into opening 2088 when contacted by first flexible member 2002.

As described above, flexing of second flexible member 2004 thereby reduces bounce, reduces settling time, and improves reliability, for switch 2000.

The embodiments described herein can be varied and combined in any manner. Variations of the above-described embodiments can be formed to construct multi pole, multi throw switches as well as arrays.

Figure 21:
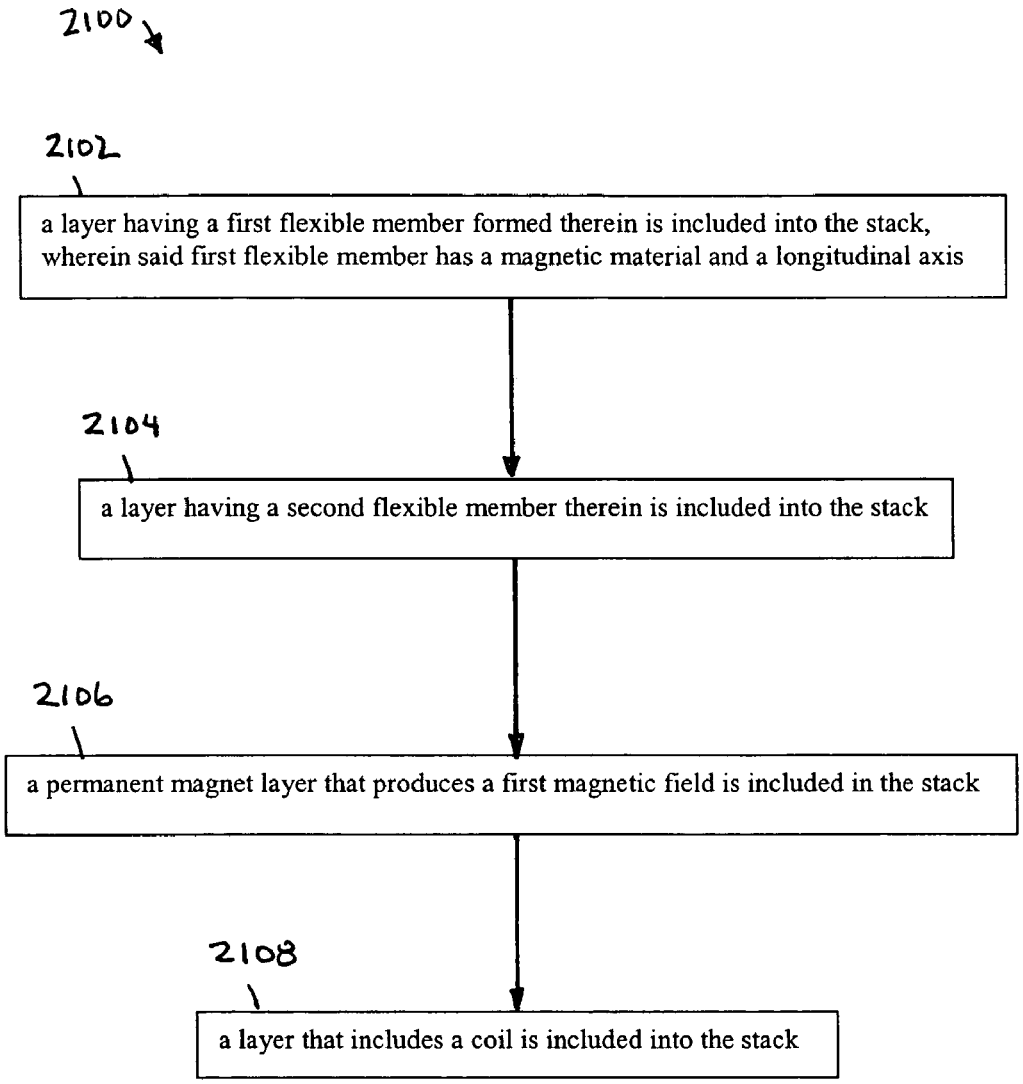
FIG. 21 shows a flowchart providing example steps for assembling a latching switch by attaching a plurality of layers together in a stack, according to an example embodiment of the present invention.

FIG. 21 shows a flowchart 2100 providing example steps for assembling a magnetically actuated latching switch by attaching a plurality of layers together in a stack, according to an example embodiment of the present invention. Other structural and operational embodiments will be apparent to persons skilled in the relevant art(s) based on the following discussion. For example, the steps of flowchart 2100 can be adapted to assembling switches with other actuation mechanisms. The steps shown in FIG. 21 do not necessarily have to occur in the order shown. The steps of FIG. 21 are described in detail below.

Flowchart 2100 begins with step 2102. In step 2102, a layer having a first flexible member formed therein is included into the stack, wherein said first flexible member has a magnetic material and a longitudinal axis. For example, the layer can be layer 1414 shown in FIG. 14A, which includes first flexible member 1402 (or can be any other similarly configured layer described elsewhere herein). As described above, first flexible member 1402 includes a magnetic material, and has a longitudinal axis 1436. Alternatively, the layer can be layer 1614 shown in FIG. 16A, which includes first flexible member 1602.

In step 2104, a layer having a second flexible member therein is included into the stack. For example, the layer can be layer 1410 shown in FIG. 14A, which includes second flexible member 1404 (or can be any other similarly configured layer described elsewhere herein). Alternatively, the layer can be layer 1610 shown in FIG. 16A, which includes second flexible member 1604 (and third flexible member 1680), or layer 1914, with second flexible member 1904, for example.

In step 2106, a permanent magnet layer that produces a first magnetic field is included in the stack. For example, the permanent magnet layer can be permanent magnet layer 1430 shown in FIG. 14A or permanent magnet layer 1630 shown in FIG. 16A.

In step 2108, a layer that includes a coil is included into the stack. For example, the layer can be layer 1418 shown in FIG. 14A or layer 1618 shown in FIG. 16A.

In embodiments, further steps can include including spacer layers into the stack, including a soft magnetic layer into the stack, including electrically conductive layers into the stack, including dielectric layers into the stack, and/or other steps that are apparent from the description above.

FIG. 22 shows a flowchart 2200 providing example steps for operating a magnetically actuated latching switch with multiple flexible members, according to an example embodiment of the present invention. Other structural and operational embodiments will be apparent to persons skilled in the relevant art(s) based on the following discussion. The steps shown in FIG. 22 do not necessarily have to occur in the order shown. The steps of FIG. 22 are described in detail below.

Flowchart 2200 begins with step 2202. In step 2202, a first magnetic field is produced by a permanent magnet, which thereby induces a magnetization in a magnetic material of a first flexible member in a layer of a stack, the magnetization characterized by a magnetization vector pointing in a direction along a longitudinal axis of the first flexible member, the first magnetic field being approximately perpendicular to the longitudinal axis.

For example, in an embodiment, the first magnetic field can be magnetic field 1434 produced by permanent magnet layer 1430, as shown in FIG. 14A. Magnetic field 1434 induces a magnetization in the magnetic material of first flexible member 1402. Alternatively, the first magnetic field can be magnetic field 1634 produced by permanent magnet layer 1630, as shown in FIG. 16A. Magnetic field 1634 induces a magnetization in the magnetic material of first flexible member 1602.

In step 2204, a second magnetic field is produced to cause the first flexible member to switch between a first stable state and a second stable state, wherein in the first stable state, the first flexible member is in contact with a second flexible member in a layer of the stack, wherein the second flexible member flexes in response, wherein only temporary application of the second magnetic field is required to change direction of the magnetization vector thereby causing the first flexible member to flex into contact with the second flexible member.

For example, in an embodiment, the second magnetic field is produced by coil 1432, as shown in FIG. 14A. The second magnetic field causes first flexible member 1402 to switch between a first stable state (e.g., similarly to as shown in FIG. 13C) and a second stable state. Alternatively, in another embodiment, the second magnetic field is produced by coil 1632, as shown in FIG. 16A. The second magnetic field causes first flexible member 1602 to switch between a first stable state (e.g., similarly to as shown in FIG. 15B) and a second stable state (e.g., as shown in FIG. 16A).

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A latching switch, comprising:

a plurality of layers attached together in a stack, including:

a layer having a first flexible member therein, wherein said first flexible member has a magnetic material and a longitudinal axis;

a layer having a second flexible member therein;

a permanent magnet layer that produces a first magnetic field, which induces a magnetization in said magnetic material, said magnetization characterized by a magnetization vector pointing in a direction along the longitudinal axis of the first flexible member, wherein the first magnetic field is approximately perpendicular to said longitudinal axis; and a layer that includes a coil that produces a second magnetic field to cause the first flexible member to switch between a first stable state and a second stable state, wherein in the first stable state, the first flexible member is in contact with the second flexible member, which flexes in response.

2. The switch of claim 1, wherein the first flexible member includes a first electrical conductor and the second flexible member includes a second electrical conductor, wherein in the first stable state, the first electrical conductor is in contact with the second electrical conductor.

3. The switch of claim 1, wherein the layer having the second flexible member includes a third flexible member.

4. The switch of claim 3, wherein in the first stable state, the first flexible member is in contact with the second and third flexible members, which both flex in response.

5. The switch of claim 4, wherein the first flexible member includes a first electrical conductor, the second flexible member includes a second electrical conductor, and the third flexible member includes a third electrical conductor, wherein in the first stable state, the first electrical conductor is in contact with both of the second and third electrical conductors.

6. The switch of claim 1, wherein a temporary current input to said coil produces said second magnetic field such that a component of said second magnetic field parallel to said longitudinal axis changes direction of said magnetization vector thereby causing said first flexible member to switch between the first and second stable states.

7. The switch of claim 1, wherein the first flexible member is not in contact with the second flexible member in the second stable state.

8. The switch of claim 7, wherein the first flexible member is moved away from said second flexible member in said second stable state.

9. The switch of claim 1, wherein the layer that includes the first flexible member further comprises:

a U-shaped portion held between layers of the stack;

opposing first and second flexure members which are each coupled between an inner end portion of the U-shaped portion and an opposing side of the first flexible member.

10. The switch of claim 9, wherein the opposing first and second flexure members are axially aligned and torsionally flex when the first flexible member moves.

11. The switch of claim 1, wherein the layer that includes the first flexible member further comprises:

a ring-shaped portion held between layers of the stack;

opposing first and second flexure members which are each coupled between an inner edge of the ring-shaped portion and an opposing side of the first flexible member.

12. The switch of claim 11, wherein the opposing first and second flexure members are axially aligned and torsionally flex when the first flexible member moves.

13. The switch of claim 1, wherein the first flexible member includes a first electrically conductive tip portion, and the second flexible member includes a second electrically conductive tip portion, wherein in the first stable state, the first electrically conductive tip portion is in contact with the second electrically conductive tip portion.

14. The switch of claim 13, wherein at least one of the first and second electrically conductive tip portions is shaped to enhance contact between the first and second electrically conductive tip portions when in the first stable state.

15. The switch of claim 1, wherein the first flexible member includes:

a first electrically conductive layer;

a soft magnetic layer that includes the magnetic material; and a dielectric layer between the electrically conductive layer and soft magnetic layer.

16. The switch of claim 15, wherein the second flexible member includes:

an electrically conductive layer;

a second electrically conductive layer;

a third electrically conductive layer; and a second dielectric layer between the second and third electrically conductive layers.

17. The switch of claim 16, wherein the first and second electrically conductive layers are in contact in the first stable state.

18. The switch of claim 17, wherein the soft magnetic layer and the third electrically conductive layer are coupled to a ground potential.

19. The switch of claim 1, wherein the stack includes a plurality of electrically conductive vias, each via located through at least one layer of the stack.

20. The switch of claim 1, wherein at least a portion of the plurality of electrically conductive vias are coupled to corresponding externally accessible contacts for electrically coupling the latching switch to a circuit board.

21. The switch of claim 19, wherein a first electrically conductive via is in electrical contact with the layer that includes the first flexible member.

22. The switch of claim 21, wherein the first electrically conductive via is in electrical contact with an externally accessible contact pad.

23. The switch of claim 21, wherein a second electrically conductive via is in electrical contact with the layer that includes the second flexible member.

24. The switch of claim 23, wherein the second electrically conductive via is in electrical contact with a second externally accessible contact pad.

25. The switch of claim 20, wherein the externally accessible contacts are solder ball pads.

26. The switch of claim 20, wherein the externally accessible contacts are pins.

27. The switch of claim 1, wherein the plurality of layers are laminated together in the stack.

28. The switch of claim 1, wherein the stack further comprises:

a plurality of spacer layers each having an opening therethrough, wherein the plurality of spacer layers provide a cavity for at least one of the first and second flexible members to move in.

29. The switch of claim 28, wherein the plurality of spacer layers include at least one spacer layer between the layer having the first flexible member and the layer having the second flexible member.

30. The switch of claim 28, wherein the stack further comprises:

a cover layer to enclose a side of the cavity.

31. The switch of claim 1, wherein the stack further comprises:

a layer that includes a soft magnetic material.

32. The switch of claim 1, wherein the second flexible member is a bent portion of the layer having a second flexible member therein.

33. A latching switch, comprising:

a first layer having a first flexible member formed therein, wherein said first flexible member has a magnetic material and a longitudinal axis;

a second layer that includes an opening therethrough;

a third layer having a second flexible member therein; and a fourth layer that includes a permanent magnet that produces a first magnetic field, which induces a magnetization in said magnetic material, said magnetization characterized by a magnetization vector pointing in a direction along the longitudinal axis of the first flexible member, wherein the first magnetic field is approximately perpendicular to said longitudinal axis;

wherein during operation, the first flexible member switches between a first stable state and a second stable state, wherein in the first stable state, the first flexible member is in contact with the second flexible member, which flexes in response, wherein in the second stable state, the first flexible member is not in contact with the second flexible member;

wherein in the first stable state, the first flexible member moves through a cavity formed at least in part by said opening to contact the second flexible member.

34. The latching switch of claim 33, further comprising:

a fifth layer that includes a coil that produces a second magnetic field thereby causing the first flexible member to switch between the first stable state and the second stable state.

35. The switch of claim 33, further comprising:

a fourth layer that covers a side of the cavity.

36. A latching switch, comprising:

a first layer having a first flexible member formed therein;

a second layer that includes an opening therethrough;

a third layer having a second flexible member therein; and a fourth layer that includes a soft magnetic material;

wherein during operation, the first flexible member switches between a first stable state and a second stable state, wherein in the first stable state, the first flexible member is in contact with the second flexible member, which flexes in response, wherein in the second stable state, the first flexible member is not in contact with the second flexible member;

wherein in the first stable state, the first flexible member moves through a cavity formed at least in part by said opening to contact the second flexible member.

37. The switch of claim 33, wherein the second flexible member is a bent portion of the third layer.

* * * * *

UNITED STATES PATENT AND TRADEMARK OFFICE

CERTIFICATE OF CORRECTION

PATENT NO. : 7,215,229 B2
APPLICATION NO. : 10/740837
DATED : May 8, 2007
INVENTOR(S) : Shen et al.

It is certified that error appears in the above-identified patent and that said Letters Patent is hereby corrected as shown below:

Title Page

Item[56], FOREIGN PATENT DOCUMENTS section please replace "EP 0 869 518 A1 10/1998" with --EP 0 869 519 A1 10/1998--.

Signed and Sealed this

Seventh Day of August, 2007

JON W. DUDAS
*Director of the United States Patent and Trademark Office*